US006287090B1

(12) United States Patent
Hamasaki et al.

(10) Patent No.: US 6,287,090 B1
(45) Date of Patent: Sep. 11, 2001

(54) ELECTRIC PUMP APPARATUS

(75) Inventors: Yoshiaki Hamasaki, Kashiba; Takayasu Yamazaki, Tenri; Toshio Iida, Kashiwara, all of (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

(21) Appl. No.: 09/397,600

(22) Filed: Sep. 16, 1999

(30) Foreign Application Priority Data

| | | |
|---|---|---|
| Sep. 18, 1998 | (JP) | 10-265057 |
| Dec. 28, 1998 | (JP) | 10-374719 |
| Jul. 9, 1999 | (JP) | 11-196751 |

(51) Int. Cl.[7] ..... F04B 17/00
(52) U.S. Cl. ..... 417/360
(58) Field of Search ..... 417/360, 423.3, 417/410.4; 285/305, 321

(56) References Cited

U.S. PATENT DOCUMENTS

| | | | | |
|---|---|---|---|---|
| 5,692,883 | | 12/1997 | Vourc'h | 417/312 |
| 5,853,204 | * | 12/1998 | Bartholomew | 285/305 |

FOREIGN PATENT DOCUMENTS

| | | | |
|---|---|---|---|
| 748 939 | | 12/1996 | (EP) . |
| 0819854A2 | * | 1/1998 | (EP) . |
| 819854 | | 1/1998 | (EP) . |
| 9-4571 | | 1/1997 | (JP) . |
| 9-105385 | | 4/1997 | (JP) . |
| 10-82377 | | 3/1998 | (JP) . |

* cited by examiner

*Primary Examiner*—Timothy S. Thorpe
*Assistant Examiner*—William H Rodriguez
(74) *Attorney, Agent, or Firm*—Darby & Darby

(57) ABSTRACT

The present invention provides an electric pump apparatus which can be assembled easily by providing a groove having a shape corresponding to that of an opening of a bottomed-cylindrical tank cylinder on pump side end surface of a bracket for supporting the pump and electric motor on its both ends so that the tank cylinder constitutes a reservoir for operating fluid, detachably attaching an opening-side-end portion of the tank cylinder into the groove, and engaging a snap ring with a side wall of the groove; and which is designed to be compact in which a Suppression chamber for pulsation-reduction of discharged fluid is integrally provided, by constituting the suppression chamber with the opening side of the groove is sealed by an intermediate plate provided in-between the opening side and pump.

3 Claims, 27 Drawing Sheets

ELECTRIC PUMP APPARATUS

BACKGROUND OF THE INVENTION

The present invention relates to an electric pump apparatus, particularly concerns such an electric pump apparatus made to be a compact for vehicle-mount, which has a reservoir for storing operating fluid, the reservoir has a constitution in which an electric motor serving as a driving source is integrally attached on one side of a pump via a bracket, a opening-side-end portion of a tank cylinder is secured on the pump-supporting surface of the bracket so as to surround the pump.

In recent years, automobiles are equipped with various hydraulic-actuating devices, such as a power steering apparatus and automatic transmission apparatus, which are actuated by oil pressure to assist driving operation. Accordingly, pumps which generates oil pressure for these hydraulic-actuating devices are also equipped.

This type of the pumps are generally driven by engine as a driving source; however, since engine widely changes its rotational speed while traveling, engine is not quite appropriate for the driving source. When engine is used as the driving source, various problems arise in which power-consumption for driving the pump causes an increase in fuel-consumption rate, and furthermore mounting position of the pump could be limited due to obtaining transmission from the engine. For these reasons, in recent years, electric pump apparatuses, which use an electric motor as a driving source that is driven by power supply from a car-mounted battery instead of the engine, have been replacing the engine-driven-pump apparatuses.

Meanwhile, electric vehicles (EVs) have been developed in order to prevent environmental deterioration due to exhaust gases, because the EV use an electric motor for the driving source instead of engine. Even the EVs may be mounted with hydraulic-actuating devices, therefore electric pump apparatuses using electric motors as driving sources are inevitably applied with respect to generation sources of oil pressure for such hydraulic-actuating devices.

Furthermore, with respect to the electric pump apparatuses of this type, compactness is strongly demanded in order to improve the mountability onto vehicles. Japanese Laid-Open Patent Application No. 10-82377 (1998) by the applicant of the present invention has disclosed an electric pump apparatus in which: a trump is supported on one side of a bracket with an electric motor being supported on the other side, and both of these are connected at the axial portion of the bracket while a bottomed-cylindrical tank cylinder being secured on the pump-supporting surface of the bracket so as to surround the pump, and thus a reservoir for storing operating fluid is constituted, furthermore, mountability onto vehicle is enhanced by integrating the reservoir and electric motor with the pump.

Here, in the above-mentioned electric pump apparatus disclosed in Japanese Laid-Open Patent Application No. 10-82377 (1998), securing of the tank cylinder is achieved by allowing a flange circumferentially provided on its opening-side-end portion to contact the supporting surface of the bracket and fastening them together with a supporting flange of the electric motor being contacted to the other surface of the bracket by a plurality of securing bolts placed along the circumferential direction. However, the problem with the electric pump apparatus is that the assembly including this securing process is very complex.

Here, in the case when the electric pump apparatus constructed as described above is mounted on a vehicle, so-called "longitudinally-aligned arrangement" in which a pump shaft (input shaft) of the pump is longitudinally connected with a motor shaft (output shaft) of the electric motor is mainly adopted. In some cases for types of vehicle having a limitation of their mounting position, so-called "transversally-aligned arrangement" in which the both shafts are transversally connected may be adopted.

In order to make it applicable to both types, two types of tank cylinders are prepared: one is for longitudinal application in which an oil filler port for operating fluid is opened on bottom surface that faces up when mounted, and the other is for transversal application in which similar oil filler port is opened on circumferential surface, and either of these types will be selected depending on the alignment type. However, if the assembly has been carried out with an incorrect selection, the tank cylinder can not be removed solely, and thus the assembly including the installation of the electric motor has to started over.

Moreover, the above-mentioned tank cylinder is made out of a thin cylindrical body, therefore it tends to be damaged due to various reasons while in-use. When a replacement of the tank cylinder is required due to such a damaged, a complex task including adjustments of assembly of the electric motor which needs to he removed together with the tank cylinder will also be required. Therefore, replacement on assembly basis including the pump and electric motor is conventionally conducted instead of on part basis; this causes an increase in costs required for the replacement.

Here, the pump in the electric pump apparatus constituted as described above is provided as a rotational volume type such as a gear pump or vane pump. In the pump of this type, since intermittent discharging are carried out in response to the rotation of rotors, it is not avoidable to have the discharging oil without containing pulsations. Therefore, this results in disadvantages such as damages in the piping system on discharging side and generation of noises.

These pulsations are generated mainly with a frequency corresponding to the product between rotational rate of the rotors and the number of discharges per rotation. For this reason, the pulsations are effectively reduced by placing an accumulator having its inner volume corresponding to this frequency in a halfway of the piping system on the discharging side.

However, in the car-mounted electric pump apparatus, it is difficult to mount the accumulator in the halfway of the piping system in the most of the cases. Therefore, in the aforementioned electric pump apparatus disclosed in Japanese Laid-Open Patent Application No. 10-82377 (1998), a suppression chamber having the aforementioned inner volume is constructed inside a reservoir formed on the other side of the pump, and this suppression chamber is used as an accumulator by communicating it with the discharging side of the pump, and thus pressure fluid whose pulsations have been reduced while passing through the suppression chamber is sent out to the discharging side.

As described above, the electric pump apparatus disclosed in Japanese Laid-Open Patent Application No. 10-82377 (1998) has a constitution in which the driving electric motor and reservoir are integrally formed with the pump. Moreover, the apparatus also has a constitution in which the pulsations on the discharging side is reduced by having the suppression chamber as an integral part; thus, it is very easy for car application.

However, the comparatively bulky suppression chamber that requires a predetermined inner volume as described above is placed together with the reservoir on the other side of the pump (on the opposite side to the mounting side of the electric motor), and the electric motor, pump, suppression chamber, and reservoir are aligned in the shaft direction. Therefore, this constitution limits a reduction of the entire size of the apparatus in the shaft direction, and thus it does not sufficiently meet the demand of compactness for car-mount-use.

BRIEF SUMMARY OF THE INVENTION

The present invention has been devised to solve the above-mentioned problems, and one of the objectives of the present invention is to provide an electric pump apparatus integrally having a reservoir with a pump and electric motor, by adopting a supporting configuration in which a tank cylinder, which constitutes a reservoir for storing operating fluid, is solely detachably attached to a bracket for supporting the pump and electric motor; thereby simplifying its assembly, enabling for replacement of the tank cylinder alone.

Another objective of the present invention is to provide a more compact electric pump apparatus by reducing its shaft direction dimension, with an effective arrangement of a suppression chamber for reducing pulsations.

The electric pump apparatus of the present invention in which a reservoir is constituted by circumferentially providing a groove on the pump side end surface of a cylindrical bracket for supporting the pump and electric motor, and fitting an opening-side-end portion of a bottomed-cylindrical tank cylinder into the groove so as to surround the pump, is characterized in that the opening-side-end portion of the tank cylinder is fitted into the groove circumferentially provided to the pump side end surface, an anti-come-off ring is engaged with a side wall of the groove, and thus the tank cylinder is secured so as not to come off from the groove.

In the present invention, the groove having a shape corresponding to the opening end of the tank cylinder is provided on one surface of the bracket to which the tank cylinder is secured for constituting the reservoir, the opening-side-end portion of the tank cylinder is fitted into the groove, and this fitting portion is engaged with the anti-come-off ring being engaged with the side wall of the groove so as to secure to the groove without coming off lose. This secured condition is easily cancelled without giving an adverse effect on the securing of the electric motor, by removing the anti-come-off ring, and pulling the opening-side-end portion of the tank cylinder out from the groove.

Moreover, another electric pump apparatus of the present invention is characterized in that the anti-come-off ring is a snap ring having a circular cross-section.

In this invention, the snap ring having a circular cross-section is used as the anti-come-off ring. Therefore, mounting of the anti-come-off ring in-between the groove provided in the bracket and the tank cylinder fitted into the groove can be easier.

Furthermore, still another electric pump apparatus of the present invention is characterized in that the tank cylinder is provided with: a fitting portion which has a predetermined length from the opening edge of the tank cylinder with a thickness approximately equal to width of the groove; an inlet surface which is located at a position farther than the fitting portion from the opening edge and which faces the side wall of the groove with a gap into which the anti-come-off ring is allowed to be introduced when being fitted; a guide surface which is located between the inlet surface and fitting portion, which outwardly inclined toward the opening edge to introduce the anti-come-off ring along the inlet surface to an engaging position of the anti-come-off ring; and an engage surface which is continuously provided with the guide surface while having a curved surface and which comes contact with the anti-come-off ring being engaged at the engaging position.

In his invention, when the fitting portion, provided to the opening edge of the tank cylinder, is fitted into the groove having a width corresponding to the thickness of the fitting portion, the inlet surface thinner than the fitting portion is made to be facing against the side wall of the groove with a predetermined gap. therefore, the anti-come-off ring is easily introduced through this gap. Moreover, the anti-come-off ring introduced as described above is further introduced into its engaging position along the inclined guide surface continuously provided with the guide surface, and the tank cylinder is firmly secured without coming off from the groove by contacting the anti-come-off ring to the curved engage surface continuously provided with the guide surface.

Moreover, still another electric pump apparatus of the present invention is characterized by comprising a biasing member which is intervened between the opening edge of the tank cylinder and the bottom surface of the groove, and which biases the tank cylinder to a direction away from the bottom surface, and thus the biasing member pushes the engage surface onto the anti-come-off ring.

In this invention, the biasing member, intervened between the bottom surface of the groove provided to the bracket and the opening edge of the tank cylinder fitted into the groove, presses be tank cylinder in a direction away from the bottom surface of the groove, and thus the tank cylinder is held at secured state. Therefore, tilting of the tank cylinder within a mounting gap, caused by the effect of weight of operating fluid stored inside the tank cylinder, is prevented when used in the "transversally-aligned arrangement", for example.

Still another electric pump of the present invention in which an input shaft (motor shaft) of the electric motor is attached to one side of the pump via the bracket, and the input shaft is connected together with a pump shaft (output shaft) of the pump, while the bracket is intervened between the pump and electric motor, and a suppression chamber is provided in a discharging path of the pump, and thus pulsations of pressurized fluid being discharged into the discharging path due to a transmitted force from the electric motor are reduced by the suppression chamber, is characterized in that the suppression chamber is provided to the bracket.

In this invention, a space constituted to the bracket provided for mounting the electric motor on the one side of the pump, excluding the connecting portion of the pump and electric motor, is utilized to constitute a suppression chamber for pulsation-reduction, and therefore a lengthwise space required for placing the suppression chamber on the other side of the pump is eliminated and thus the length in the shaft direction is shortened, as the result that the total size of the apparatus can be made more compact.

Moreover, still another electric pump apparatus of the present invention is characterized in that a recess provided on the portion of the bracket opposing to the pump is sealed by the intermediate plate intervened between the bracket and pump.

In this invention, the recess is provided on the surface of the bracket opposing to the pump, and the suppression chamber is constituted so as to attain a necessary inner volume between the intermediate plate intervened between the pump and bracket and the inside of the recess. Here, the intermediate plate is secured between the pump and bracket, and is having a strong structure to stand with a high pressure inside of the suppression chamber.

Furthermore, still another electric pump apparatus of the present invention is characterized in that the intermediate plate is made of a high-tensile-strength aluminum material.

In this invention, the intermediate plate can be made comparatively lighter and thinner, therefore the total apparatus size in the shaft direction can be reduced, thus the entire apparatus can be much more compact. In other words, when the suppression chamber is constituted by the recess provided to the portion of the bracket opposing to the pump and the intermediate plate, operable area of reaction force of the fluid pressure applied to the intermediate plate from the suppression chamber will be increased. In addition, it is necessary to increase structural strength of the intermediate plate in order to raise the maximum discharging pressure of the pump more than a predetermined value. Thus, to raise the structural strength of this intermediate plate, the plate thickness has to be raised more than a predetermined thickness; however, this idea becomes inconsistent with the objective of achieving the compactness and light-weight for the apparatus. Moreover, if the intermediate plate is made of some sort of materials with high rigidity such as carbon steels, weight of the entire apparatus will increase. As oppose to these problems, the present invention makes it possible to easily provide a compact and light-weight apparatus.

Moreover, still another electric pump apparatus of the present invention is characterized in that the suppression chamber is provided around the input shaft of the pump in a winding manner.

In this invention, since flow path length of the pressurized fluid inside of the suppression chamber can be made longer than the ferential length of the suppression chamber, it is not necessary to provide the suppression chamber larger. In other words, the bracket in which the suppression chamber is provided can be smaller, and the pulsations can be effectively reduced. That is, in order to effectively reduce the pulsations of the pressurized fluid discharged from the pump, the longer the length of the flow path of the pressurized fluid inside the suppression chamber having the pressurized fluid storage with a predetermined volume, the better. However, on the contrary, the suppression chamber becomes bulky, with the result that the entire electric pump apparatus becomes large. In contrast, the present invention makes it possible to lengthen the length of the flow path of the pressurized fluid inside of the suppression chamber without making the suppression chamber larger, and also to effectively reduce the pulsations. Moreover, the winding of the suppression chamber makes it possible to increase strength of the suppression chamber portion in the bracket and consequently to further make the bracket much more compact.

Still another electric pump apparatus of the present invention is characterized in that the suppression chamber is built inside the bracket.

In this invention, the suppression chamber can be constituted only with the bracket; therefore, as compared with a case in which the recess and intermediate plate constitute a suppression chamber, the number of parts can be reduced and costs can be greatly reduced. Further, the bracket is provided with an inlet hole for introducing the pressurized fluid discharged from the pump to the suppression chamber. Moreover, since acting area of the reaction force of the pressurized fluid applied to the pump from the suppression chamber is reduced as compared with a case in which the recess and intermediate plate constitute the suppression chamber, a necessary axial force of the securing bolt for securing the pump to the bracket can be reduced, with the result that the pump can be firmly secured by using smaller size securing bolts and the entire apparatus can he made much more compact, consequently.

Furthermore, the other electric pump apparatus of the present invention is provided with a plurality of flanges which are respectively secured to the intermediate plate by securing screws (securing bolts); a synthetic-resin-made reservoir for surrounding the pump; a metal-made collar which is inserted through a perforation provided in each of the flanges; and a metal-made washer plate which is intervened between the collar and intermediate plate, and in which a plurality of the washer plates are integrally formed.

In this invention, when the intermediate plate is made of nonferrous metal such as an aluminum alloy, and when the reservoir is secured to the intermediate plate by fastening securing screws, the collar prevents the flange of the synthetic-resin-made reservoir from buckling, and also bucking of mounting surface of the intermediate plate can be effectively prevented by the washer plates; thus, it becomes possible to ensure a predetermined fastening axial force. Moreover, since the plurality of the washer plates are integrally formed, as compared with a case in which all the plurality of the washer plates are individually formed, the number of occurrences of dimensional errors in the washer plates can be reduced, the dimensional management of the washer plates ran be easily made, the operability of the securing process of the reservoir can be improved, and it is possible to prevent the washer plates from being erroneously left unsecured at the time of the securing process.

The above and further objects and features of the invention will more fully be apparent from the following detailed description with accompanying drawings.

DETAILED DESCRIPTION OF THE INVENTION

Referring to Figures, the following description will discuss embodiments of the present invention in detail.

Embodiment 1

Figure 1:
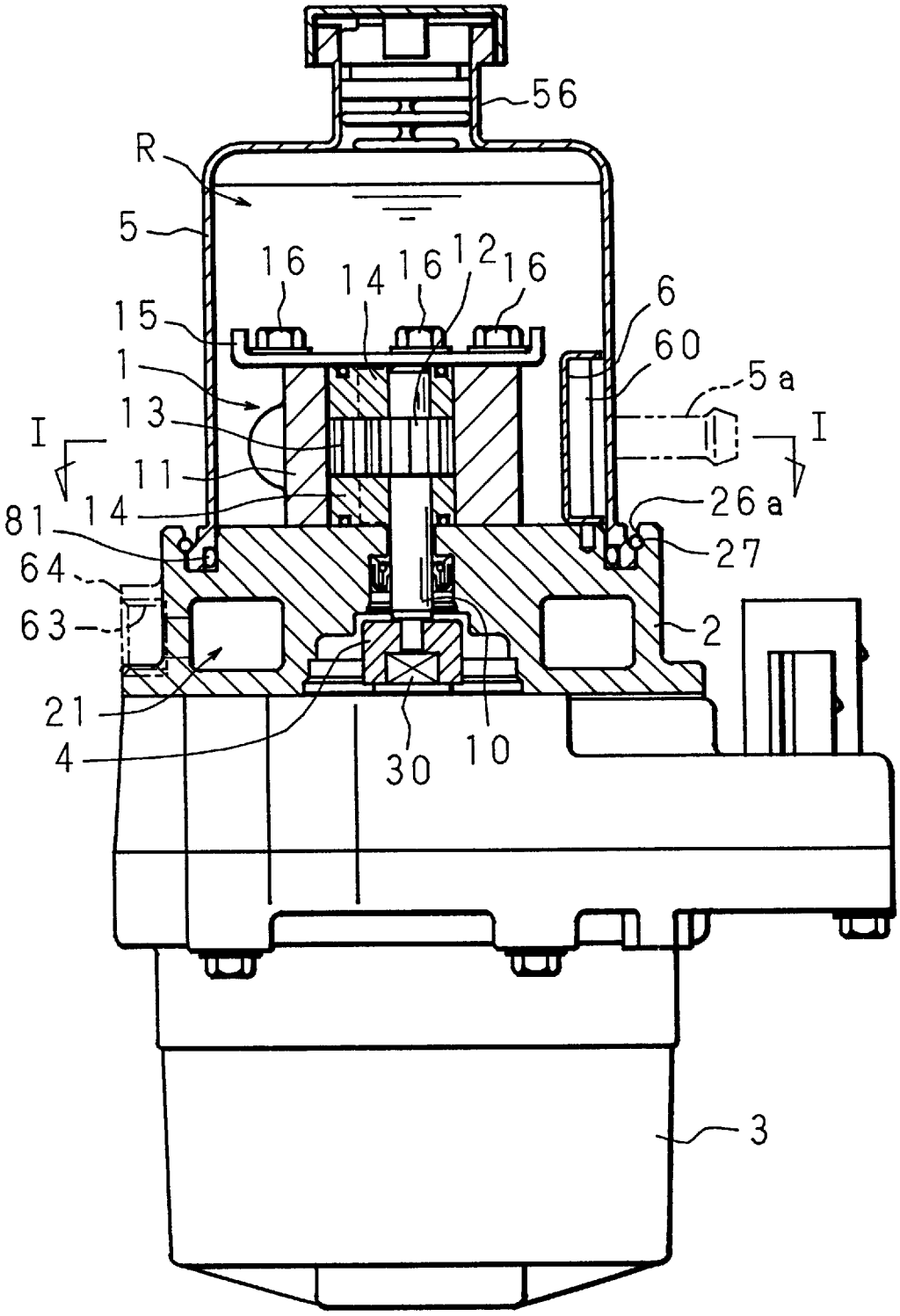
FIG. 1 is an exploded side view showing an essential part of the first embodiment of an electric pump apparatus according to the present invention.
Figure 2:
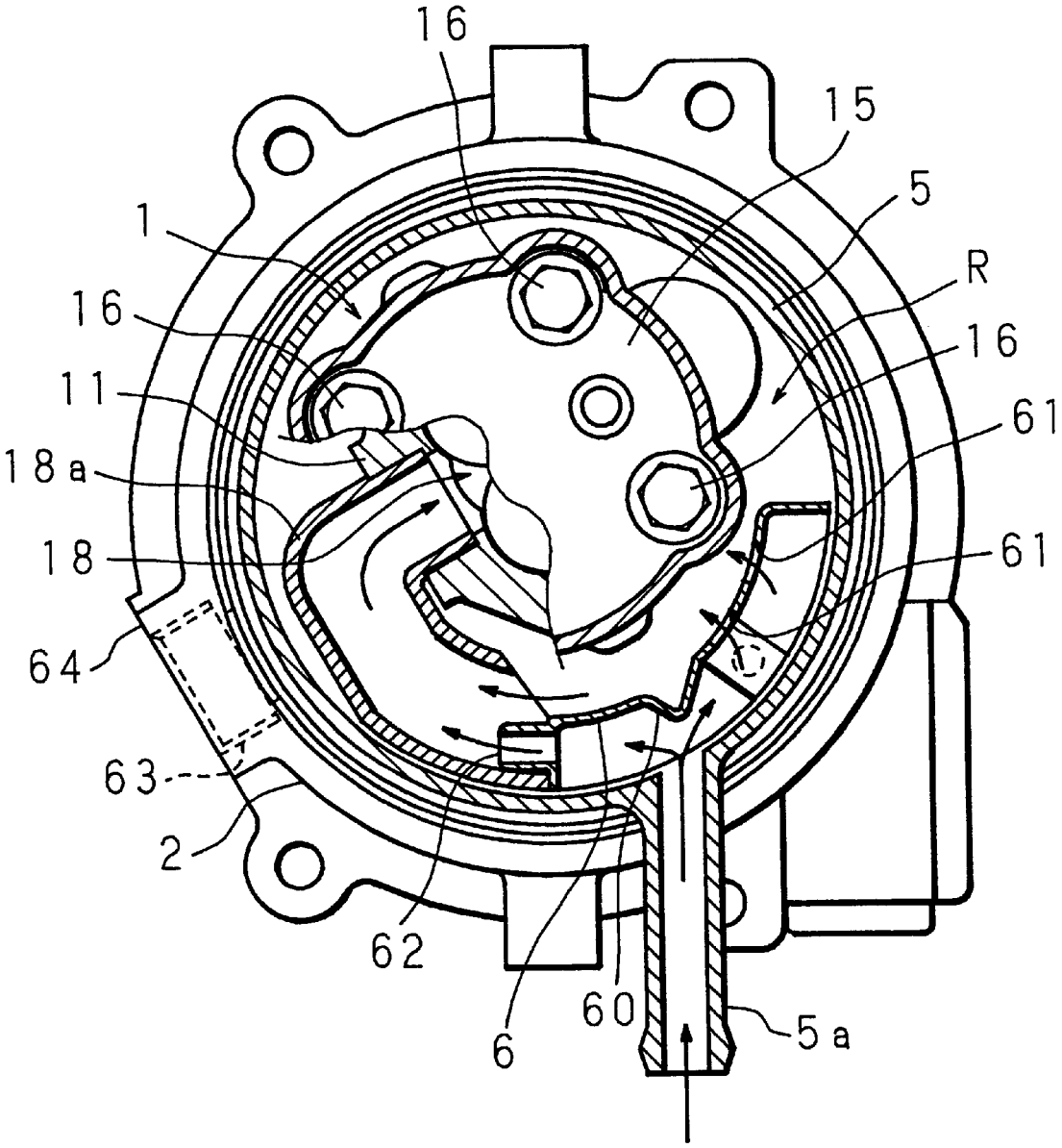
FIG. 2 is a lateral cross-sectional view taken along line I—I of FIG. 1.

FIG. 1 is an exploded side view showing an essential part of the first embodiment of an electric pump apparatus according to the present invention and FIG. 2 is a lateral cross-sectional view taken along line I—I of FIG. 1.

In the electric pump apparatus of the first embodiment, a bracket 2 having a short cylindrical shape, which has one surface side on which a pump 1 is supported, has the other surface side to which a driving-use electric motor 3 is attached. A pump shaft 10 serving as an input shaft to the pump 1 aid a motor shaft 30 serving as an output shaft of the electric motor 3 are co-axially aligned inside the bracket 2, and coupled together by a fit-in-type coupling 4. Thus, the driving force of the electric motor 3 taken out by the motor shaft 30 is transmitted to the pump shaft 10 through the coupling, 4 so as to drive the pump 1.

The pump 1, which is a known gear pump, is placed inside a cavity portion (gear chamber) with an elongated-circle cross-section, formed in a housing 11, so as to allow a driving gear 12 and driven gear 13 to engage with each other. Operating fluid, inside of a suction chamber 18 (see FIG. 2) that is provided on one side of this engaging section, is pressurized while being transported in a seated state between the respective gear teeth and inner circumferential surface of the cavity portion due to rotation of the gears 12 and 13, and discharged into an outlet chamber (not shown) provided on the other side of the engaging section. Here, in FIG. 1, the driven gear 13 is shown as its one portion being overlapped by the driven gear 12 located on the front side of the drawing paper surface.

The driving gear 12 and driven gear 13 are rotatably supported at their both ends by a pair of side plates 14 that are insectedly fitted into the cavity portion of the housing 11 from both sides of the gears, while being maintained in the above-mentioned engaging state. The pump 1 arranged as described above, which allows one-side-end surface of the housing 11 to contact the supporting surface of the bracket 2, is secured to the end surface of the bracket 2 by fastening a plurality of securing bolts 16 (four bolts are shown in FIG. 2) arranged along the circumferential direction, together with an end plate 15 overlapped on the other-side-end surface.

The pump shaft 10, fitted into the axial center of the driving gear 12, is allowed to penetrate through one of the side plates 14 toward the bracket 2 side, and connected to the motor shaft 30 of the electric motor 3 via the coupling 4. Therefore, with respect to the pumping movement by the pump 1 is carried out in which: rotation of the electric motor 3 is transmitted to the driving gear 12 through the motor shaft 30, coupling 4, and pump shaft 10 in that order, so that the driving gear 12 rotates within inner cavity portion of the housing 11, together with the driven gear 13 in mesh therewith.

A tank cylinder 5, which consists of a thin plate member having a bottomed cylindrical shape, has its opening-side-end portion attached to the bracket 2 for supporting the above-mentioned pump 1 so as to surround the pump 1. In other words, a reservoir R for storing operating fluid is formed inside the tank cylinder 5.

Figure 3:
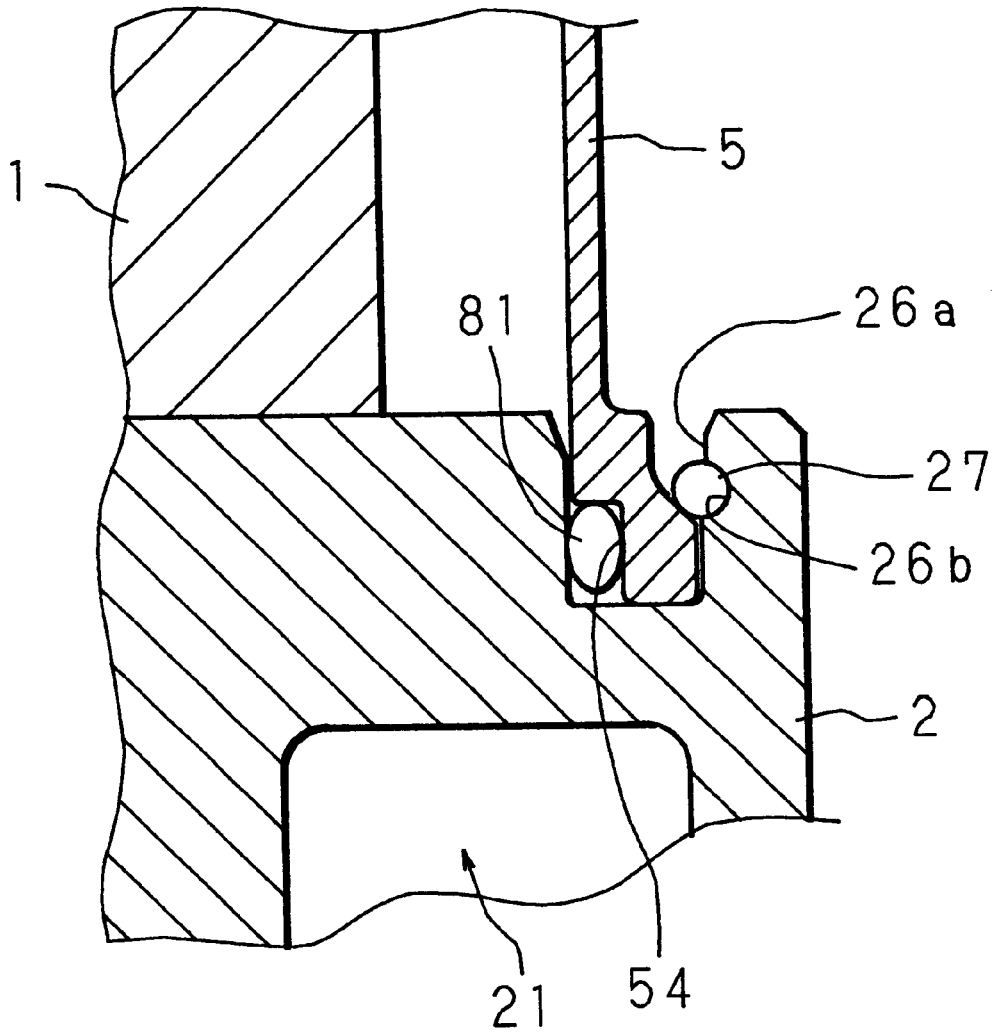
FIG. 3 is an enlarged cross-sectional view showing proximity of securing section of a tank cylinder shown in FIG. 1.

One of the features of the electric pump apparatus of the present invention lies in its securing structure of the tank cylinder 5. FIG. 3 is an enlarged cross-sectional view showing proximity of the securing section of the tank cylinder 5 shown in FIG. 1. As illustrated in FIGS. 1 and 3, on one side surface of the bracket 2, to which the pump 1 is supported, a groove 26*a* having a circular shape on its plan view that corresponds to the opening edge of the tank cylinder 5 is circumferentially provided so as to surround the pump 1. The above-mentioned tank cylinder 5 has its opening-side-end portion fitted into the groove 26*a*, with this fitting portion contacting a snap ring 27 engaging with outside side wall of the groove 26*a* so as be secured without coming off from the groove.

Figure 4:
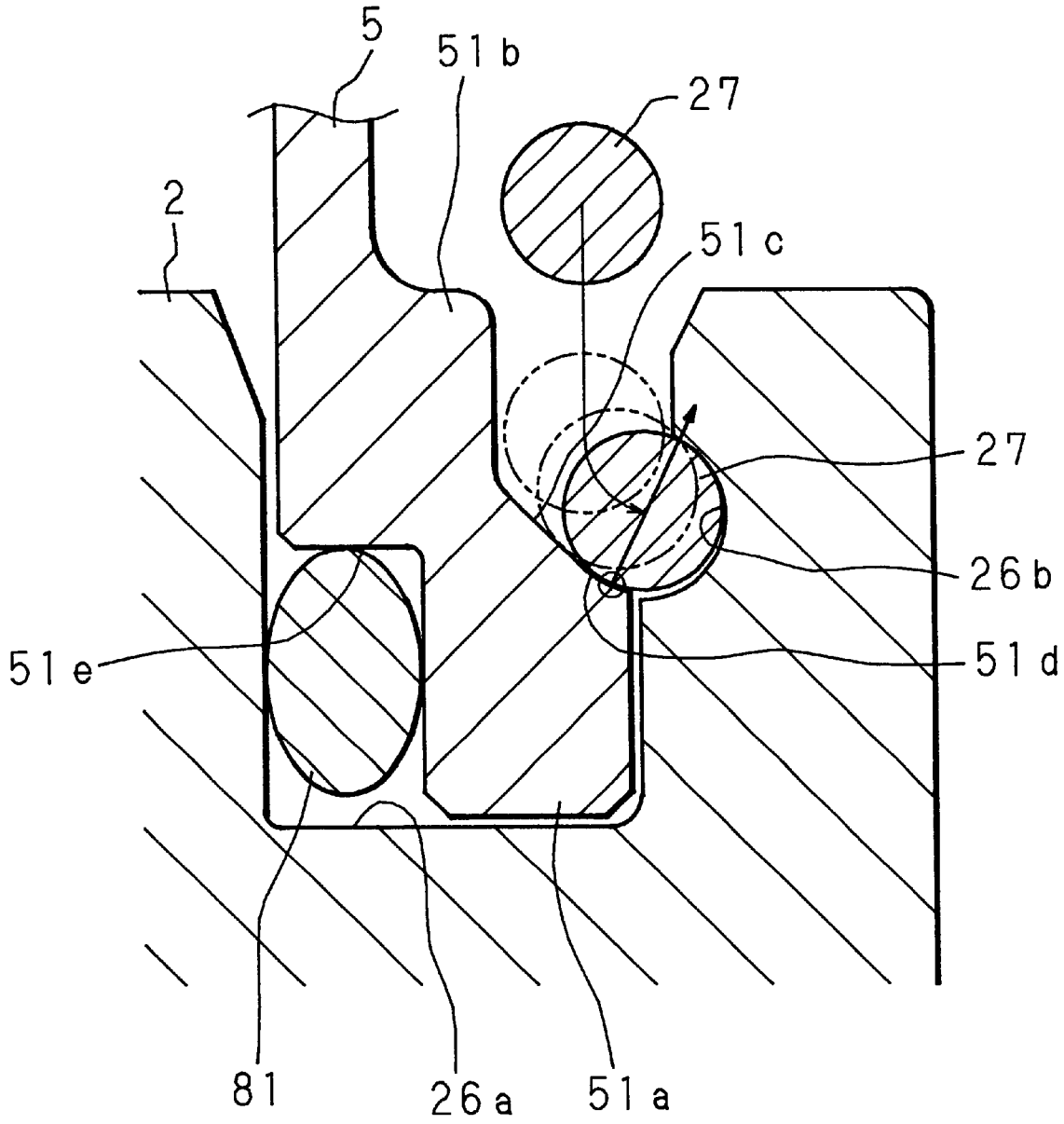
FIG. 4 is an explanatory drawing showing a sequence of securing procedures of the tank cylinder shown in FIG. 1.

FIG. 4 is an explanatory drawing showing a sequence of securing procedures of the tank cylinder 5 shown in FIG. 1. The tank cylinder 5 is provided with a fitting portion 51*a*, inlet surface 51*b*, guide surface 51*c*, and engage surface 51*d*.

The fitting portion 51*a* is formed so as to have a thickness approximately equal to width of the groove 26*a* over an appropriate length from the opening edge of the tank cylinder 5. The inlet surface 51*b* has a thickness made to be thinner than the fitting portion 51*a* , and is formed on the side away from the opening edge. The guide surface 51*c* is located between the inlet surface 51*b* and fitting portion 51*a* so as to outwardly inclined toward the opening edge. The engage surface 51*d* has curved surface continuously formed with the guide surface 51*c*.

The tank cylinder 5 having the above-mentioned arrangement is supported with the fitting portion 51*a* on the opening edge side thereof being tightly fitted into the groove 26*a,* and secured in this state. Here, as illustrated in FIG. 4, the input surface 51*b* is allowed to face side wall of the groove 26*a* with a predetermined gap, and the guide surface 51*c* continuously formed and the engage surface 51*d* are continuously formed with a semi-circle engagement groove 26*b* formed on the side wall of the groove 26*a* so as to engage with the snap ring 27.

The snap ring 27 is a sort of snap-on-type stop ring having a circular cross-section, cut at one place on its circumferential direction so as to have C-shape, and thus it is allowed to reduce in its diameter by closing the notched width. This snap ring 27 is introduced into the gap between the inlet surface 51*b* and side wall of the groove 26*a* while that diameter-reduced condition, and as indicated by a two-dot-chain line in FIG. 4, is further pushed into the inner side along the gap. This pushing can be securely carried out along the inlet surface 51*b* which faces in approximately parallel to the side wall of the groove 26*a*.

Upon reaching the guide surface 51*c* continuously formed with the inlet surface 51*b,* the pushed-in snap ring 27 is guided outwardly along the inclined slope of the guide surface 51*c* while expanding diameter by its own elasticity and allowed to engage the engagement groove 26*b*; thus, it comes into contact with the engage surface 51*d* formed as a curved surface as described above. Consequently, the tank cylinder 5 is secured with the fitting portion 51*a* fitted into the groove 26*a* being prevented from coming off by the snap ring 27.

Here, the engage surface 51*d* formed as the curved surface is contacting the snap ring 27 serving as an anti-come-off ring at one point on its curved surface. Therefore, a reaction force, indicated by an arrow in FIG. 4, is exerted on the snap ring 27 from the contact point outward in the radial direction, that is, in a direction so as to strengthen engagement to the engagement groove 26*b*. Consequently, the tank cylinder 5 is securely clamped in the above-mentioned secured state.

On inner surface of the fitting portion 51*a* of the tank cylinder 5 is circumferentially provided with a notched portion 51*e* which has a rectangular cross-section. The opening edge of the tank cylinder 5 is tightly sealed with an O-ring 81 intervened in the annular gap between the notched portion 51*e* and groove 26*a*. Therefore, the operating fluid stored inside the tank cylinder 5, that is, inside the reservoir R, is prevented from leaks.

The tank cylinder 5 secured as described above is provided with, as illustrated in FIG. 2, a return opening which penetrates through the circumference wall of the tank cylinder 5 and which opens on the inner surface thereof at one position along the circumferential direction. This return opening is connected to an oil transporting end, not shown, through a return pipe 5*a* that is provided on the tank cylinder 5 in an outwardly protruding manner so that returned oil from the oil transporting end is returned to the reservoir R via the return pipe 5*a*.

Moreover, a flow-dividing plate 6 is attached to inside of the tank cylinder 5 so as to face the return opening at end of the return pipe 5*a*. This flow-dividing plate 6 is a plate member curved along the inner surface of the tank cylinder 5, and is provided with a flow-dividing protrusion 60 having a triangle cross-section that is protruded toward the return opening, in the approximately central portion. On one half portion of the flow-dividing plate 6 connecting to one side having this flow-dividing protrusion 60, a plurality of oil-returning perforations 61, which penetrate the circumference thereof, are formed, and on the other half portion of the flow-dividing plate 6 connecting to the other side, guide-out tubes 62 are formed on the end portion in parallel with each other.

As illustrated in FIG. 2, to a pump 1 placed inside the tank cylinder 5 is connected a suction tube 18*a* that communicates with a suction chamber 18 inside the housing 11. The suction tube 18*a* is a pipe or hose that radially outwardly protrude from the housing 11, and is curved along the inner surface of the tank cylinder 5. The tip portion of the guide-out tube 62 is inserted into the suction tube 18*a* that opens along the circumferential direction of the tank cylinder 5.

Here, the returned oil from the oil-feed destination through the return pipe 5*a* as described above collides with the flow-dividing protrusion 60 and is divided into two flows as indicated by arrows in FIG. 2. The returned oil that has been divided to one side (right side in FIG. 2) is returned to the tank cylinder 5 through the respective oil-returning perforations 61. The other portion of the returned oil that has been divided to the other side (left side in FIG. 2) is allowed to flow along the annular space between the inner surface of the tank cylinder 5 and the flow-dividing plate 6, and guided out to the suction tube 18*a* through the guide-out tube 62, and then directly sucked into the suction chamber 18 of the pump 1 together with operating fluid that is introduced from the reservoir R through the rest of the openings of the suction tube 18*a*.

Therefore, the operating fluid stored in the reservoir R is sucked into the suction chamber 18 through the suction tube 18*a*. Together with this, one portion of the returned oil that has been returned through the return pipe 5*a* from the oil-feed destination is divided by the flow-dividing plate 6, and introduced into the suction chamber 18 through the guide-out tube 62 with predetermined pressure and velocity. With this arrangement, the flow on the suction side is stabilized so that the generation of cavitation can be reduced.

The operating fluid, sucked into the suction chamber 18, is pressurized due to rotation of the driving gear 12 and driven gear 13 as described earlier, and discharged into an outlet chamber, not shown, that is formed on the other side of the suction chamber 18. A suppression chamber 21 having a predetermined inner volume is formed in the bracket 2 as an annular chamber that surrounds the connecting section between the pump shaft 10 and motor shaft 30. The outlet chamber of the pump 1 is allowed to communicate with the suppression chamber 21. Moreover, at one portion of the outer circumference of the bracket 2, an outlet base 64 is provided in a protruding manner as shown in FIG. 2, and a connecting port 6 that opens in the center of this outlet base 64 is allowed communicate with the suppression chamber 21 inside the bracket 2.

With the above-mentioned arrangement, the discharged oil from the pump 1 is once introduced into the suppression chamber 21, and then sent out to the oil-feed destination, not shown, through the connecting port 63. In this case, the suppression chamber 21 is allowed to absorb pulsating components of the discharged oil that is introduced from the outlet chamber of the pump 1, thereby making it possible to reduce pulsations of the discharged oil from the outlet hole. The pulsating components of the discharged oil have a frequency, as its main component, that corresponds to a product between the number of rotations of the driving gear 12 and driven gear 13 serving as rotors and the numbers of teeth of the driving gear 12 and driven gear 13 that become the number of discharges per rotation. Thus, based upon that product, the inner volume of the suppression chamber 21 is properly determined so that it becomes possible to effectively absorb the above-mentioned pulsations.

Embodiment 2

The electric pump apparatus shown in FIG. 1 is designed to be used for the "longitudinally-aligned arrangement" in which to the shaft directions of the pump 1 and electric motor 3 are aligned longitudinally, and an oil filler port 53 for operating fluid is provided on the bottom surface of the tank cylinder 5 facing upward. However, as illustrated in FIG. 5, the present invention is also applicable to an electric pump apparatus used for the "transversally-aligned arrangement" in which the shaft directions of the pump 1 and electric motor 3 are aligned transversally.

Figure 5:
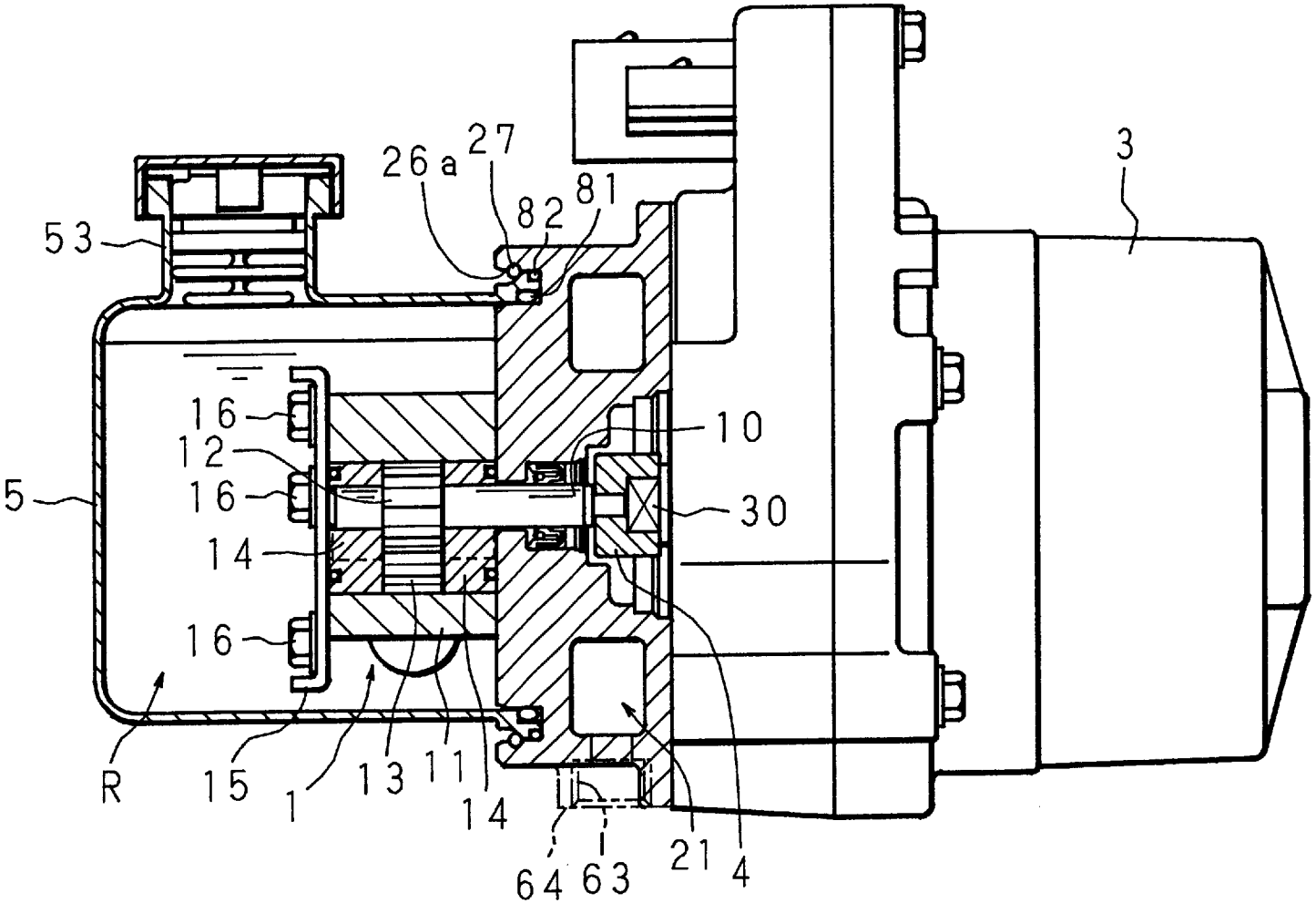
FIG. 5 is an exploded side view showing an essential part of the second embodiment of an electric pump apparatus according to the present invention, which is used in "transversally-aligned arrangement"

FIG. 5 is an exploded side view showing an essential part of the second embodiment of an electric pump apparatus according to the present invention, which is used for the "transversally-aligned arrangement." With respect to the entire constitution of this electric pump apparatus, the oil filler port 53 for supplying operating fluid into the reservoir R is focused on circumferential surface of the tank cylinder 5 so as to face upward. Except this arrangement, the electric pump apparatus of the second embodiment is similar to the electric pump apparatus of the first embodiment shown in FIG. 1; therefore, the same reference numerals are used for similar members and the detailed description of the other arrangements and functions is omitted. Here, in FIG. 5, illustrations of the return pipe 5*a* and flow-dividing plate 6 are omitted.

As shown in the electric pump apparatus of FIG. 5, similar constitution is adopted in which: the opening-side-end portion of the tank cylinder 5 is fitted into the groove 26*a* circumferentially provided on the corresponding surface of the with the snap ring 27 being engaged by the groove bracket 26*a* so as to prevent the tank cylinder 5 from coming off. However, in the case when the "transversally-aligned arrangement" as shown in the Figure is adopted, operating fluid stored inside the reservoir R is held still as indicated by its fluid surface shown in FIG. 5. Therefore, a rotational moment corresponding to weight of the operating fluid is exerted on secured portion of the tank cylinder 5, with the result that the tank cylinder 5 might tilt within a range of the fitting gap between the fitting portion 51*a* and groove 26*a*.

Figure 6:
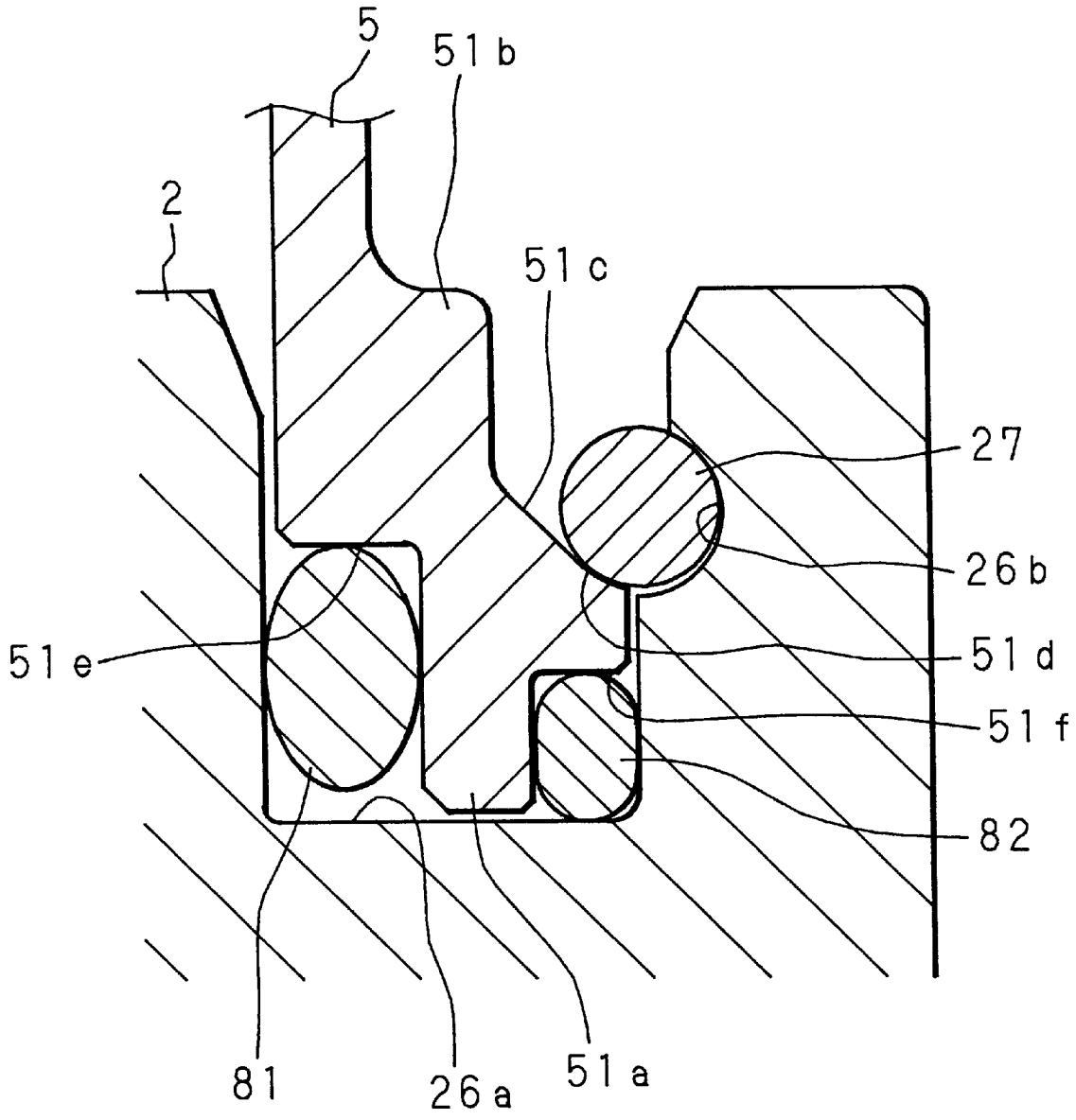
FIG. 6 is an enlarged cross-sectional view showing proximity of securing section of the tank cylinder shown in FIG. 5.

FIG. 6 is an enlarged cross-sectional view showing proximity of securing section of the tank cylinder 5 in the "transversally-aligned arrangement" shown in FIG. 5. As illustrated in FIG. 6, on the fitting portion 51*a* of the tank cylinder 5, in similar manner to the notched portion 51*e* on its inner surface, a notched portion 51*f* having a rectangular cross-section is also circumferentially provided on its outer surface, and an O-ring 82 is intervened in the annular gap between the notched portion 51*f* and groove 26*a*.

This O-ring 82 is, different from the sealing-use O-ring 81 intervened in the annular gap between the notched portion 51*e* and groove 26*a,* is intervened with a predetermined pressure being applied thereto between it and the bottom surface of the groove 26*a*. In other words, the O-ring 82 is pushing the fitting portion 51*a* of the opening end of the tank cylinder 5 to a direction away from the bottom surface of the groove 26*a,* pressing the engage surface 51*d* continuously formed with the fitting portion 51*a* against the snap ring 27 so that the clamping of the fitting portion 51*a* is strengthened. Thereby, probable tilting of the tank cylinder 5 caused by the above-mentioned rotational moment can he prevented, and thus it becomes possible to ensure a securing state even for the "transversally-aligned arrangement."

Here, the above-mentioned strengthening of the clamping by intervention of the O-ring 82 is effective even for the "longitudinally-aligned arrangement." Therefore, the securing constitution shown in FIG. 6 may of course he applied to the electric pump apparatus for use in the "longitudinally-aligned arrangement" as shown in FIG. 1. Moreover, instead of the above-mentioned O-ring 82, other biasing members, such as elastic rings having other forms and various types of springs, may be used so as to bias the opening end of the tank cylinder 5 in a direction away from the bottom surface of the groove 26*a*.

Furthermore, in the above-mentioned embodiment, the snap ring 27 having a circular cross-section is used as an anti-come-off ring for clamping the opening-side-end portion of the tank cylinder 5 that engages the groove 26*a* of the bracket 2 and is fitted into the groove 26*a,* so as not to come off; however, other type of the anti-come-off rings having different shapes may be used as long as it exerts the same functions.

Embodiment 3

Figure 7:
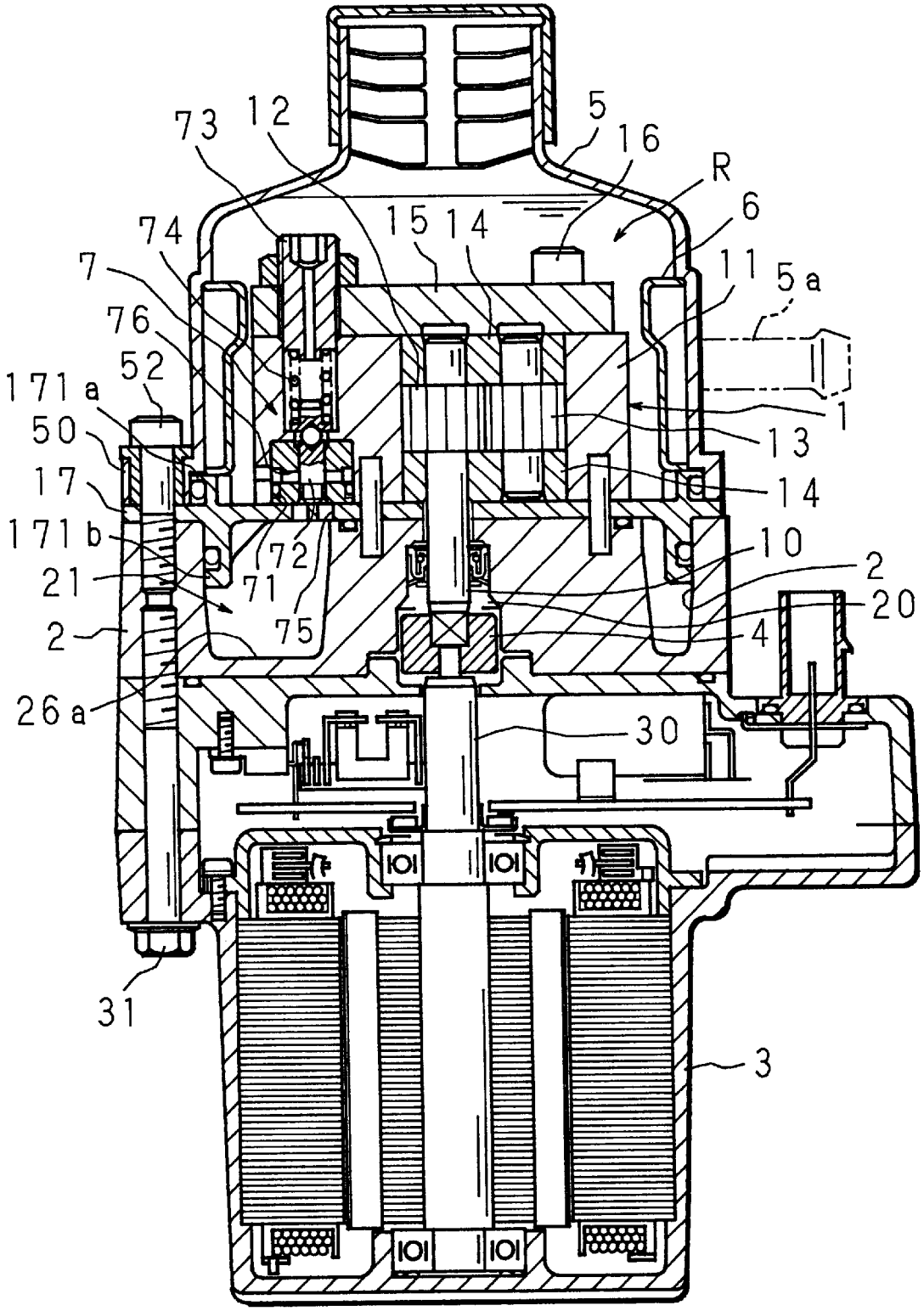
FIG. 7 is an exploded side view showing an essential part of the third embodiment of an electric pump apparatus according to the present invention.

FIG. 7 is an exploded side view showing an essential part of the third embodiment of an electric pump apparatus according to the present invention. The pump 1 of the third embodiment is sandwiched between an end plate 15 and intermediate plate 17 that are fastened together with a plurality of securing bolts 16 (only one of which is shown) aligned along the circumferential direction on both sides of the housing 11; thus, the both plates 15 and 17 prevent the side plate 14 from coming off.

The above-mentioned intermediate plate 17 is, as illustrated in FIG. 7, a flat plate having a diameter sufficiently larger than the pump 1, and an opposing side surface to the pump 1 serves as a mounting base for the bracket 2 used for mounting the electric motor 3, and the other side surface, that is a surface on the same side as the pump 1 serves as a mounting base for the tank cylinder 5 that constitutes the reservoir.

In the third embodiment, the tank cylinder 5 has its opening edge fitted into a faucet portion 171*a* that is circumferentially provided on the one-side-end surface (mounting side of the pump 1) of the intermediate plate 17, and attached so as to surround the pump 1. Moreover, the bracket 2 is a cylindrical body with approximately the same diameter as the intermediate plate 17, and its opening edge on one side is fitted to a faucet portion 171*b* that is circumferentially provided on the other-end surface of the intermediate plate 17 so that is attached co-axially with the intermediate plate 17.

As described above, the tank cylinder 5 and bracket 2 located on both sides of the intermediate plate 17 are secured together in a sandwiching manner having the intermediate plate 17 in between by fastened a plurality of securing bolts 52 (only one of which is shown), which are circumferentially placed on a securing flange 50 circumferentially provided on the former member, bolted through respective threaded holes formed at corresponding positions on outer circumferential portion of the bracket 2. The pump shaft 10 serving as an input shaft to the pump 1 is co-axially fitted into the driving gear 12 inside the housing 11, supported by the side plate 14 on both sides thereof, and allowed to protrude at axial center of the bracket 2 through a perforation penetrating through approximately center of the intermediate plate 17.

On the other hand, the electric motor 3 is circumferentially provided with a securing flange on side to which a plurality of securing bolts 31 (only one of which is shown) are inserted in circumferential direction, and the securing bolts 31 are bolted through respective threaded holes formed or the-other-end surface of the bracket 2 so that the electric motor 3 is aligned coaxially with the bracket 2. By this securing, the motor shaft 30 serving as the output shaft of the electric motor 3 is aligned co-axially with the pump shaft 10 at axial center of the bracket 2, and they are co-axially connected by the coupling 4.

Suction of operating fluid into the gear chamber is carried out through a return port, not shown, that opens on outer circumference of the housing 11, facing inside of the reservoir R constituted by the tank cylinder 5. Returned fluid from the hydraulic-actuating device is supplied into the reservoir R through the return pipe 5*a* attached on outer circumference of the tank cylinder 5. Inside the tank cylinder 5, a flow-dividing plate 6 is provided so as to face the communicating section of the return pipe 5*a,* so that the operating fluid supplied through the return pipe 5*a* loses its speed anti stays inside of the reservoir R after collided with the flow-dividing plate 6.

On the other hand, the outlet hole (not shown), for the pressurized fluid from inside of the gear chamber, is formed so as to penetrate through corresponding position of the intermediate plate 17 in the thickness direction. A groove 26*a,* which has an annular shape surrounding the connecting portion between the pump shaft 10 and motor shaft 30, and which opens on the opposite side to the intermediate plate 17, is formed in the bracket 2 provided outside the intermediate plate 17. A suppression chamber 21, which has a predetermined inner volume by sealing the opening with the intermediate plate 17, is provided on the opening side of the groove 26*a.* The outlet hole, which is formed so as to penetrate the intermediate plate 17, is allowed to open inside the suppression chamber 21.

Moreover, the suppression chamber 21 is connected to the oil-feed destination by an outlet tube, not shown, that is attached to circumference of the bracket 2. The discharged oil from the pump 1 is introduced into the suppression chamber 21 through The outlet hole that penetrates the intermediate plate 17, and then sent out to the oil-feed destination through the outlet tube. Here, the suppression chamber 21 absorbs pulsating components of the discharged oil being introduced inside thereof through the outlet hole, and thus reduces pulsations of the discharged oil from the outlet tube. The inner volume of the suppression chamber 21 can be appropriately determined based upon main frequency component of the pulsations as described above.

The suppression chamber 21, which reduces the pulsations as described above, is provided as an annular chamber surrounding the connecting portion of the pump shaft 10 and motor shaft 30 inside the bracket 2 which is provided so as to mount the driving-use electric motor 3 thereon. The bracket 2 has a required length in the shaft direction for enabling the above-mentioned connection. Thus, by utilizing within the lengthwise portion in the shaft direction of the bracket 2, the suppression chamber 21 can be constructed without increasing its entire length in the shaft direction while maintaining the above-mentioned appropriate inner volume. Therefore, it is possible to provide an electric pump apparatus which is made to be much more compact.

Furthermore, the suppression chamber 21 is to receive the discharged oil from the pump 1; however, this suppression chamber 21 is, as described above, constituted by sealing the opening side of the annular groove 26*a* formed in the bracket 2 with the intermediate plate 17. The intermediate plate 17 is firmly secured between the pump 1 and bracket 2 by a plurality of securing bolts 52 placed along the circumferential direction; thus, it is allowed to withstand high pressures inside the suppression chamber 21 with a sufficient allowance.

In the housing 11 of the pump 1, a relief valve 7 is built in one position along the circumferential direction so as to release an excessive pressure inside the suppression chamber 21. This relief valve 7 is provided with a cylindrical spool holder 71, spool 72, and spring holder 73 inside a valve hole formed by penetrating the housing It including the end plate 15 in the shaft direction. The spool holder 71 is fitted into the opening on the side opposite to the intermediate plate 17, the spool 72 is slidably held at the axial center of the spool holder 71, and the spring holder 73 is attached to the opening on the end plate 15 side of the valve hole. A relief spring 74 is intervened between the opposing surfaces of the spring holder 73 and spool 72 so that tip of the spool 72 is pressed onto the intermediate plate 17 by a spring force of the relief spring 74.

A connecting hole 75, which communicates with the suppression chamber 21 in the vicinity of pressing portion of the spool 72, is formed in the intermediate plate 17. Moreover, a relief hole 76 penetrates at halfway portion of the spool holder 71 in the radial direction, and the relief hole 76 is allowed to communicate with inside of the reservoir R constituted by the tank cylinder 5, through a communicating hole formed at the corresponding position of the housing 11. The opening end of the relief hole 76 to inside of the spool holder 71 is constituted so that the spool 72 held by the spool holder 71 is released when the spool 72 moves in a direction away from the intermediate plate 17 against spring force of the relief spring 74.

In the relief valve 7 arranged as described above, the spool 72 is pressed toward opposite to the spring force of the relief spring 74 by an inner pressure of the suppression chamber 21 that is exerted on its tip through the connecting hole 75. The spool 72 is allowed to move in a leaving direction from the intermediate plate 17 when this pressing force exceeds the spring force of the relief spring 74, and this movement releases the relief hole 76 formed in the spool holder 71 so that the inner pressure of the suppression chamber 21 is released to the reservoir R through the connecting hole 75 and relief hole 76.

The spring holder 73 with which the other end of the relief spring 74 elastically comes into contact is secured to the opening end on the end plate 15 side of the valve hole formed in the housing 11, and can be changed in its progressing length toward the valve hole by adjusting the thread. This change in length makes it possible to appropriately determined the spring force of the relief spring 74, that is, the relief pressure that is exerted against the spring force. The end of the spring holder 73 is protruded outside the end plate 15 as illustrated in FIG. 7; therefore, the adjusting operation on the thread for determining the relief pressure is easily carried out from outside the end plate 15.

Here, the other constitutions and functions of the electric pump apparatus of the third embodiment is similar to the first and second embodiments; therefore, the same reference numerals are used for similar members and the detailed description thereof is omitted.

Embodiment 4

Figure 8:
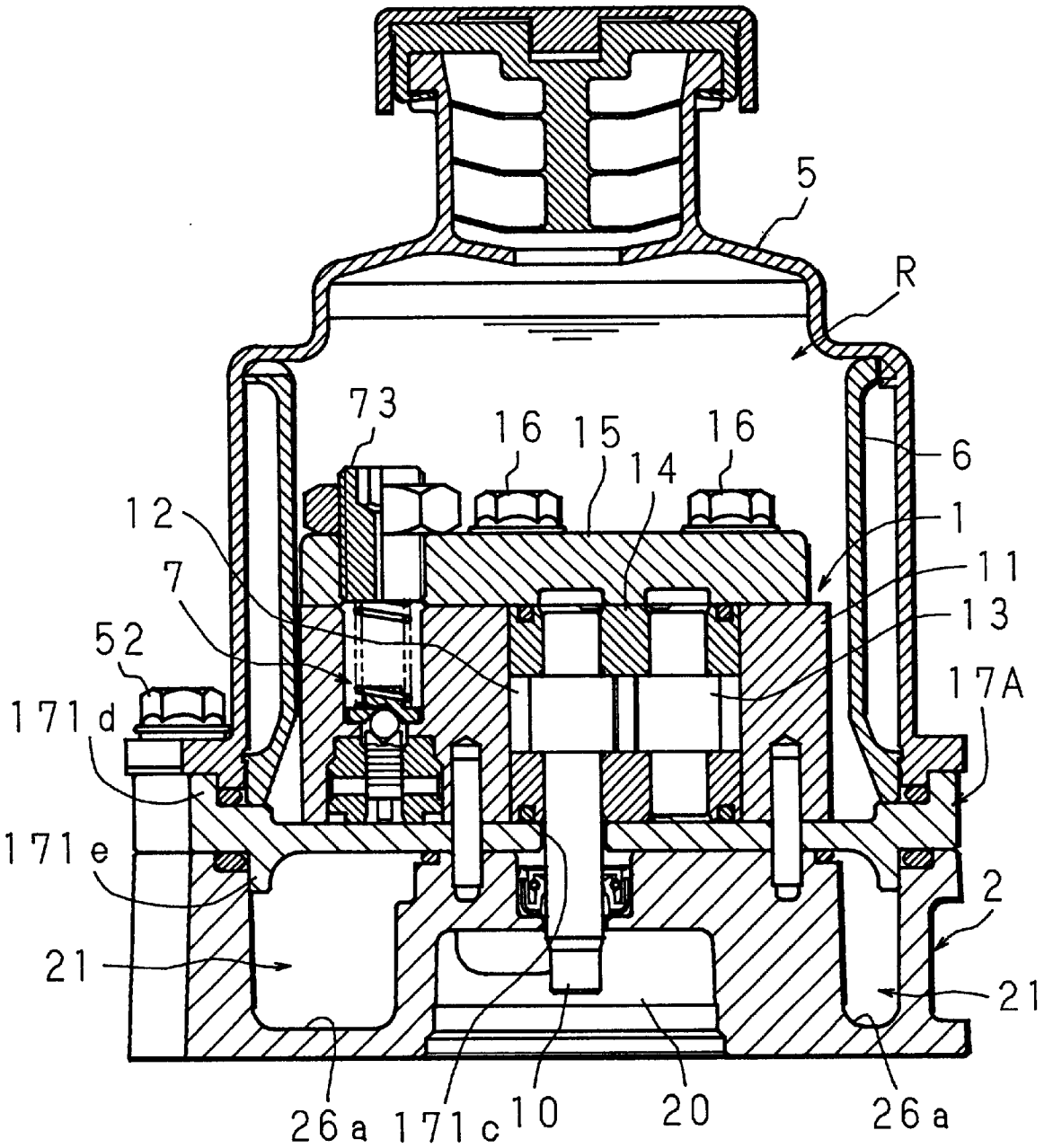
FIG. 8 is an exploded side view showing an essential part of the fourth embodiment of an electric pump apparatus from which at electric-motor section is omitted, according to the present invention.
Figure 9:
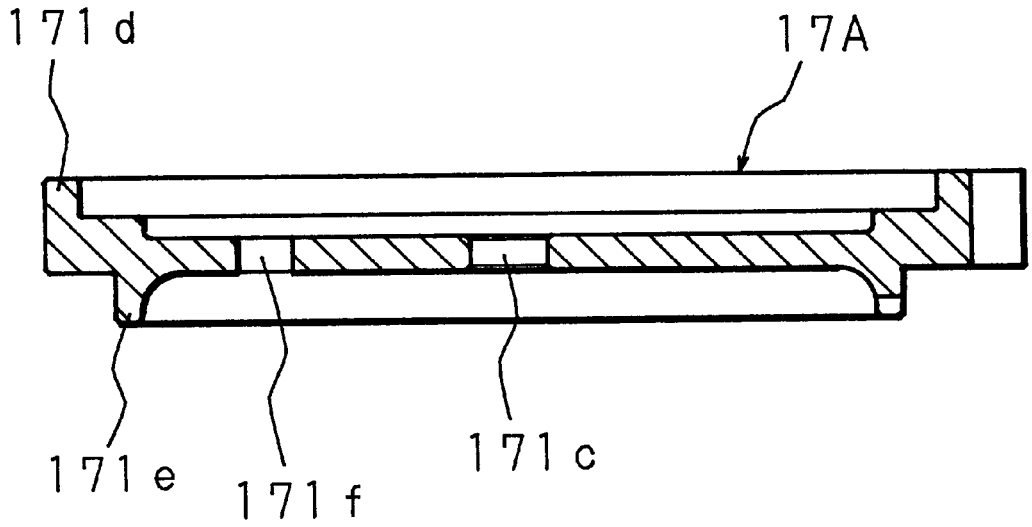
FIG. 9 is a cross-sectional view of an intermediate plate of FIG. 8.
Figure 10:
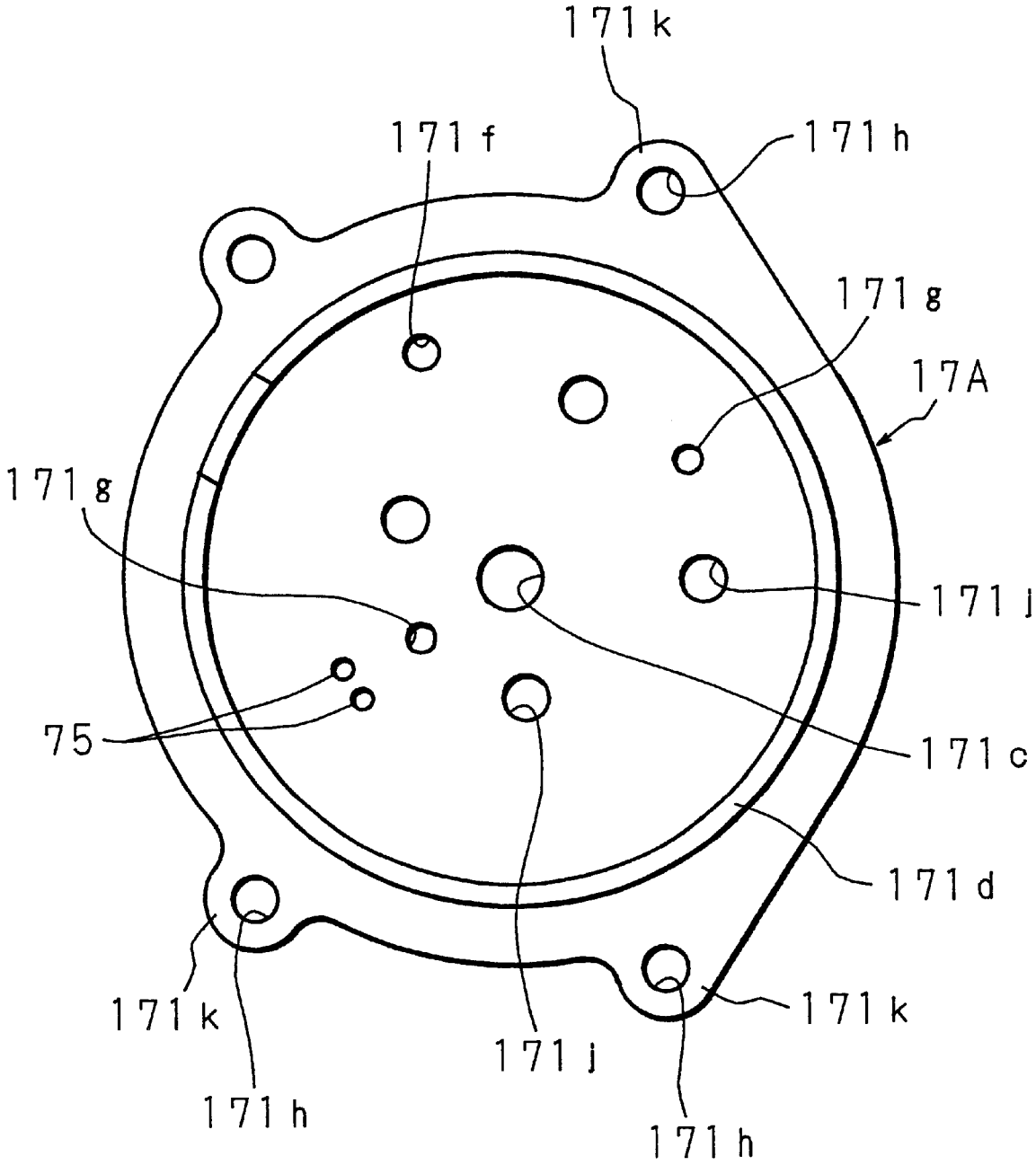
FIG. 10 is a plan view of the intermediate plate of FIG. 8.
Figure 11:
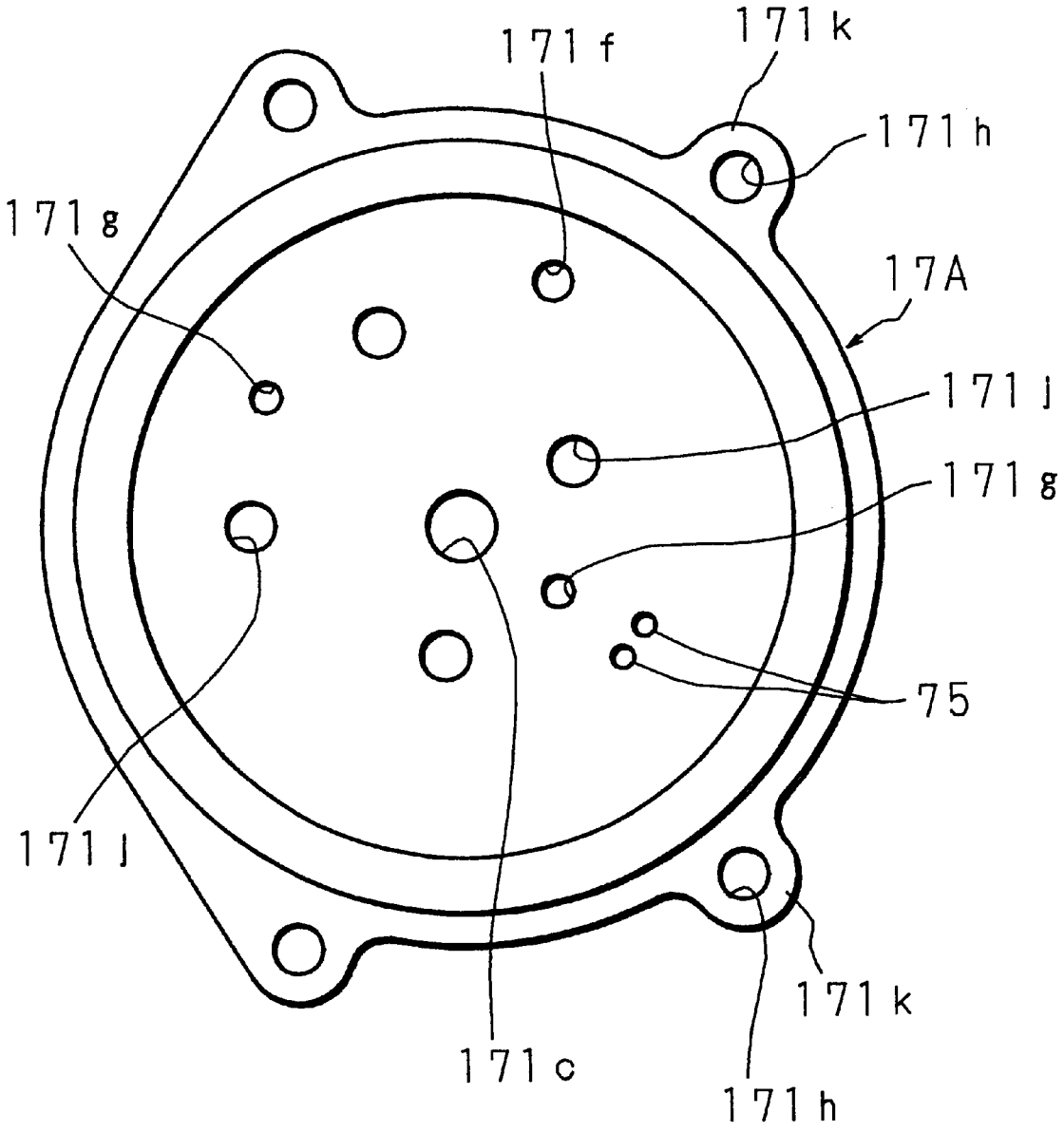
FIG. 11 is a bottom view of the intermediate plate of FIG. 8.

FIG. 8 is an exploded side view showing an essential part of the fourth embodiment of an electric pump apparatus according to the present invention, from which the section of an electric motor is omitted. FIGS. 9 through 11 are cross-sectional, plan and bottom views of the intermediate plate shown in FIG. 8 respectively.

In the electric pump apparatus of the fourth embodiment, the intermediate plate 17 constituting the suppression chamber 21 together with the groove 26*a* of the bracket 2 is made of a high-tensile-strength aluminum material. Except this arrangement, the electric pump apparatus of the fourth embodiment is similar to the electric pump apparatus of the third embodiment shown in FIG. 7; therefore, the same reference numerals are used for similar members and the detailed description of the other arrangements and functions is omitted.

The intermediate plate 17 of the electric pump apparatus of the third embodiment is made of an aluminum alloy standardized by Japanese Industrial Standard (JIS) H 2118, for example, type 12-1 or 12-2; however, an intermediate plate 17A of the fourth embodiment is made of a high-tensile-strength aluminum material standardized by JIS H 4000, such as, for example, any one of alloy numbers 2014, 2219, 2024, and 7075, or any one of alloy numbers 2014, 2024, and 7075 plus a core materials as a laminated member, or any one of alloy numbers 2014, 2024, and 7075 plus a coating material as a laminated plate.

The intermediate plate 17A is formed into a circular plate shape with a shaft hole 171*c* at the center thereof. A cylindrical faucet portion 171*d* to which the tank cylinder 5 is fitted is provided on one surface-on the pump 1 side, and a cylindrical faucet portion 171*e* to which the bracket 2 is fitted is provided on the other surface on the bracket 2 side. Moreover, an outlet hole 171*f* that communicates with the outlet chamber of the pump 1, the connecting hole 75, a pair of positioning holes 171*g*, and four perforations 171*j* through which the securing bolts 16 are inserted are respectively provided between the shaft hole 171*c*and faucet portion 17*d*. Moreover, a plurality of flanges 171*k* (four in this case), each having a perforation 171*h*, are provided in a protruding manner along the outer circumference of the intermediate plate 17A, with predetermined intervals along the circumferential direction.

In the fourth embodiment, the opening of the groove 26*a* is sealed so as to constitute the suppression chamber 21 together with a recess 20 so that the intermediate plate 17A, which has a comparatively large operable area of the fluid pressure reaction force, is made of a high-tensile-strength aluminum material; thus, it is allowed to withstand the fluid pressure reaction force even with a comparatively thin thickness. Therefore, it becomes possible to make the intermediate plate 17A much lighter with a comparatively thinner thickness, and consequently to reduce the dimension of the entire electric pump apparatus in the shaft direction so as to make the apparatus even smaller.

Embodiment 5

Figure 12:
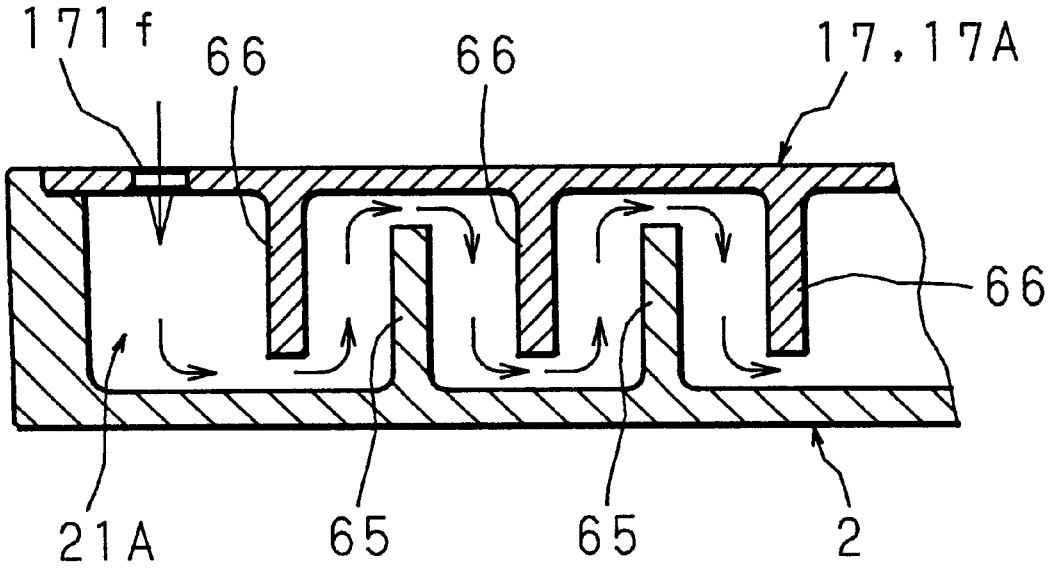
FIG. 12 is a cross-sectional view showing a suppression chamber in the fifth embodiment of an electric pump apparatus according to the present invention.
Figure 13:
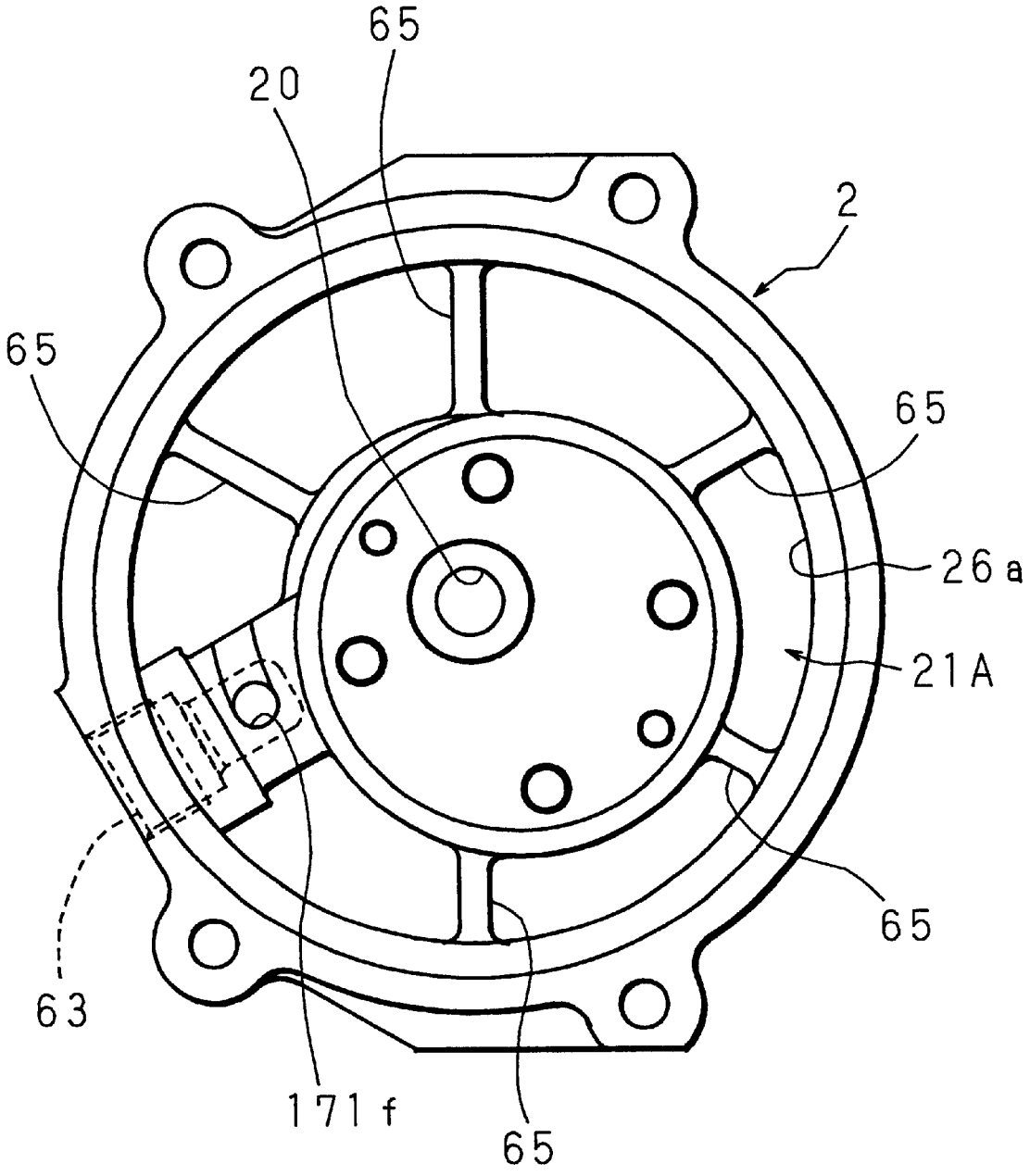
FIG. 13 is a plan view showing a bracket in the fifth embodiment of an electric pump apparatus according to the present invention.
Figure 14:
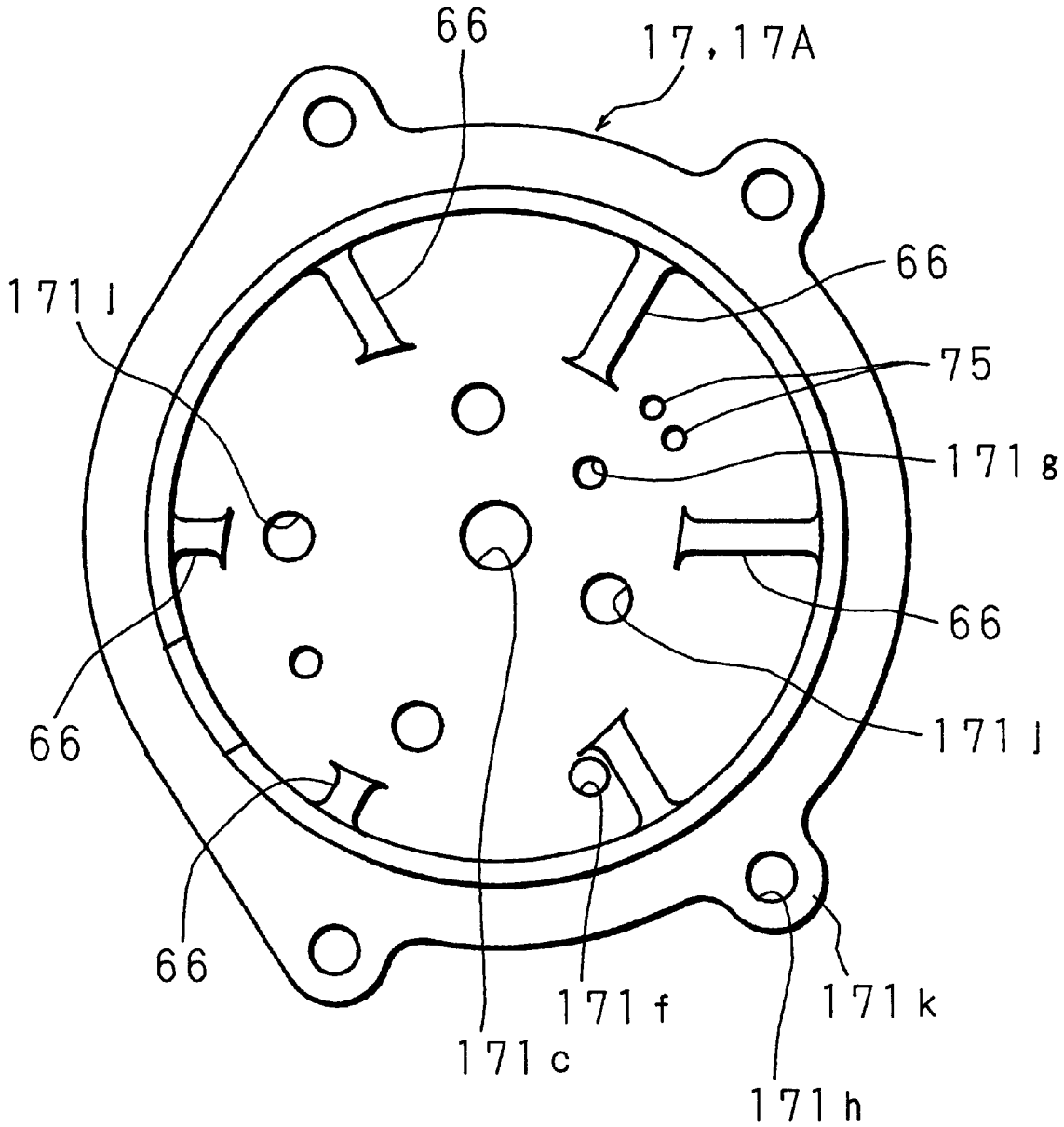
FIG. 14 is a bottom view of an intermediate plate in the fifth embodiment of an electric pump apparatus according to the present invention.

FIG. 12 is a cross-sectional view showing a suppression chamber section in the fifth embodiment of an electric pump apparatus according to the present invention. FIG. 13 is a plan showing a bracket in the fifth embodiment, and FIG. 14 is a bottom view of an intermediate plate in the fifth embodiment.

In the electric pump apparatus of the fifth embodiment, instead of forming the suppression chamber 21 without protrusions and recessions on the side wall of the annular groove 26*a*, a plurality of first and second baffle plates 65 and 66, which extend from the bracket 2 and intermediate plate 17 or 17A toward the groove 26*a*, are alternately provided with predetermined intervals along the side wall of the groove 26*a* so that a suppression chamber 21A, which is allowed to wind in circumferential directions around the pump shaft 10 and motor shaft 30 by these baffle plates 65 and 66, is formed. Except this arrangement, the electric pump apparatus of the fifth embodiment is similar to the electric pump apparatus of the third embodiment shown in FIG. 7; therefore, the same reference numerals are used for similar members and the detailed description of the other arrangements and functions is omitted.

The first and second baffle plates 65 and 66, each having a length shorter than depth of the groove 26*a*, are integrally formed with the bracket 2 and intermediate plate 17 or 17A, and when the intermediate plate 17 or 17A seals the groove 26*a*, predetermined gaps are formed between the first baffle plates 65 and bottom surface of the intermediate plate 17 or 17A, as well as between the second baffle plates 66 and surface of the recess the bracket 2, as illustrated in FIG. 12. In other words, these gaps are formed as the suppression chamber 21A winding in circumferential directions. This suppression chamber 21A is provided with the outlet hole 171*f*, which penetrates through the intermediate plate 17 or 17A and communicates with the outlet chamber of the pump 1, at one end portion along its circumferential direction. The suppression chamber 21A is also provided with a connecting port 63 of the outlet tube at the other end portion along the circumferential direction Thus, the pulsating components contained in the pressurized fluid introduced into the suppression chamber 21A from the outlet hole 171*f* is absorbed.

In the fifth embodiment, the suppression chamber 21A, which has its lengthwise direction along the circumferential direction around the pump shaft 10 and motor shaft 30 so as to wind along the circumferential direction; thereby length of the flow path within the suppression chamber 21A for the pressurized fluid is lengthened as compared with that of the flow path within the suppression chamber 21 of the first embodiment without winding. Therefore, it is possible to preferably reduce the pulsations of the pressurized fluid without the need for increasing the size of the suppression chamber 21A not more than a predetermined size, and consequently to make the bracket 2, on which the suppression chamber 21A is provided, much more compact.

Here, in the fifth embodiment, the second baffle plates 66 used for winding the suppression chamber 21A may be formed on the bracket 2 together with the first baffle plates 65, although not shown, so as to allow the suppression chamber 21A to wind, instead of providing them on the intermediate plate 17 or 17A. In this case, for example, the first baffle plates 65 are provided on one surface of a pair of circumferential surfaces that face each other in a protruding manner, and the second baffle plates 66 are provided on the other surface of the paired circumferential surfaces, and these first and second baffle plates 65 and 66 are placed alternately with a predetermined interval with each other. Furthermore, a gap is provided between the first baffle plate 65 and the one surface, as well is between the second baffle plate 66 and the other surface, so as to form a suppression chamber 21A winding along the circumferential direction.

Embodiment 6

Figure 15:
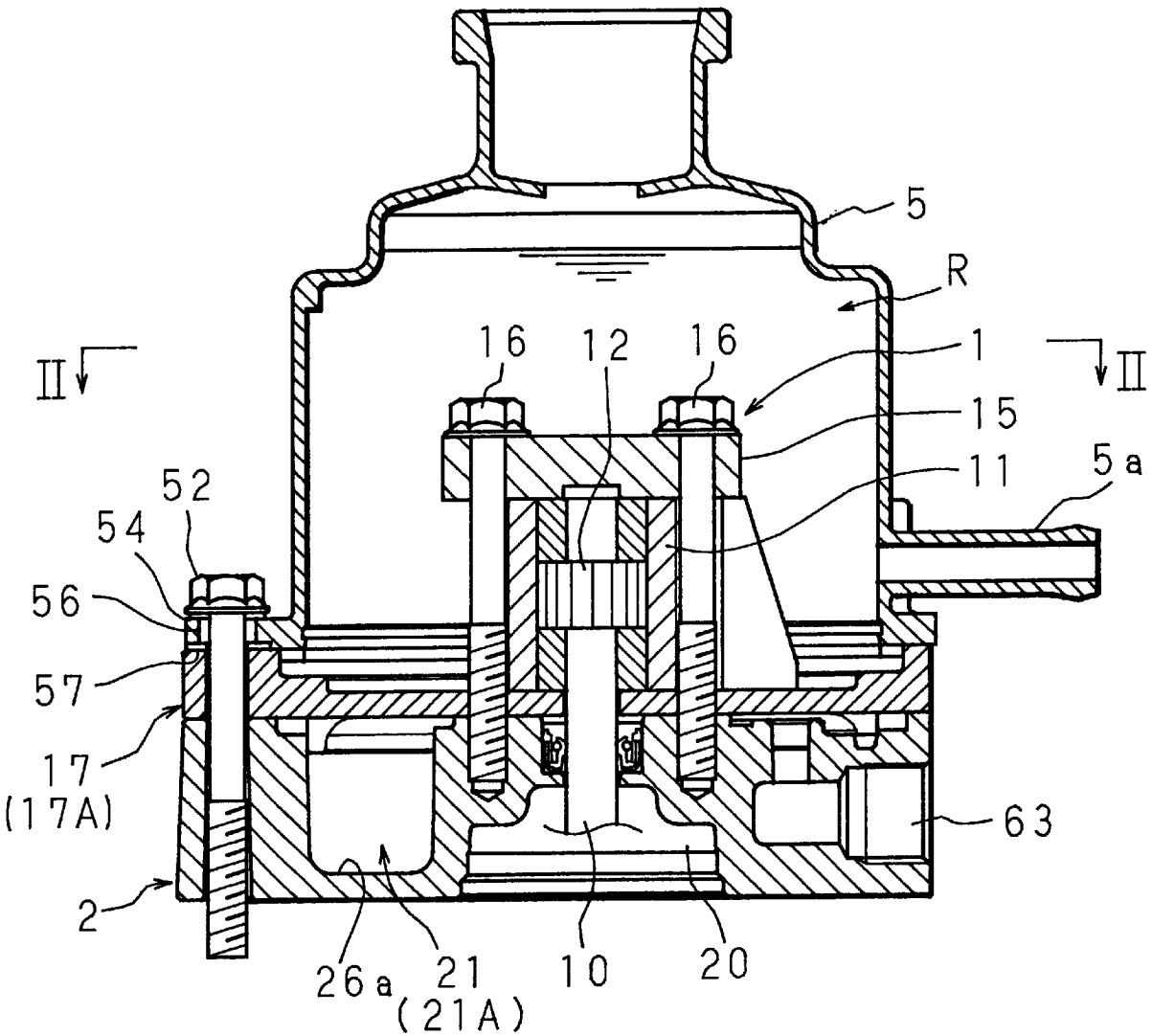
FIG. 15 is an exploded side view showing an essential part of the sixth embodiment of an electric pump apparatus from which an electric-motor section is omitted, according to the present invention.
Figure 16:
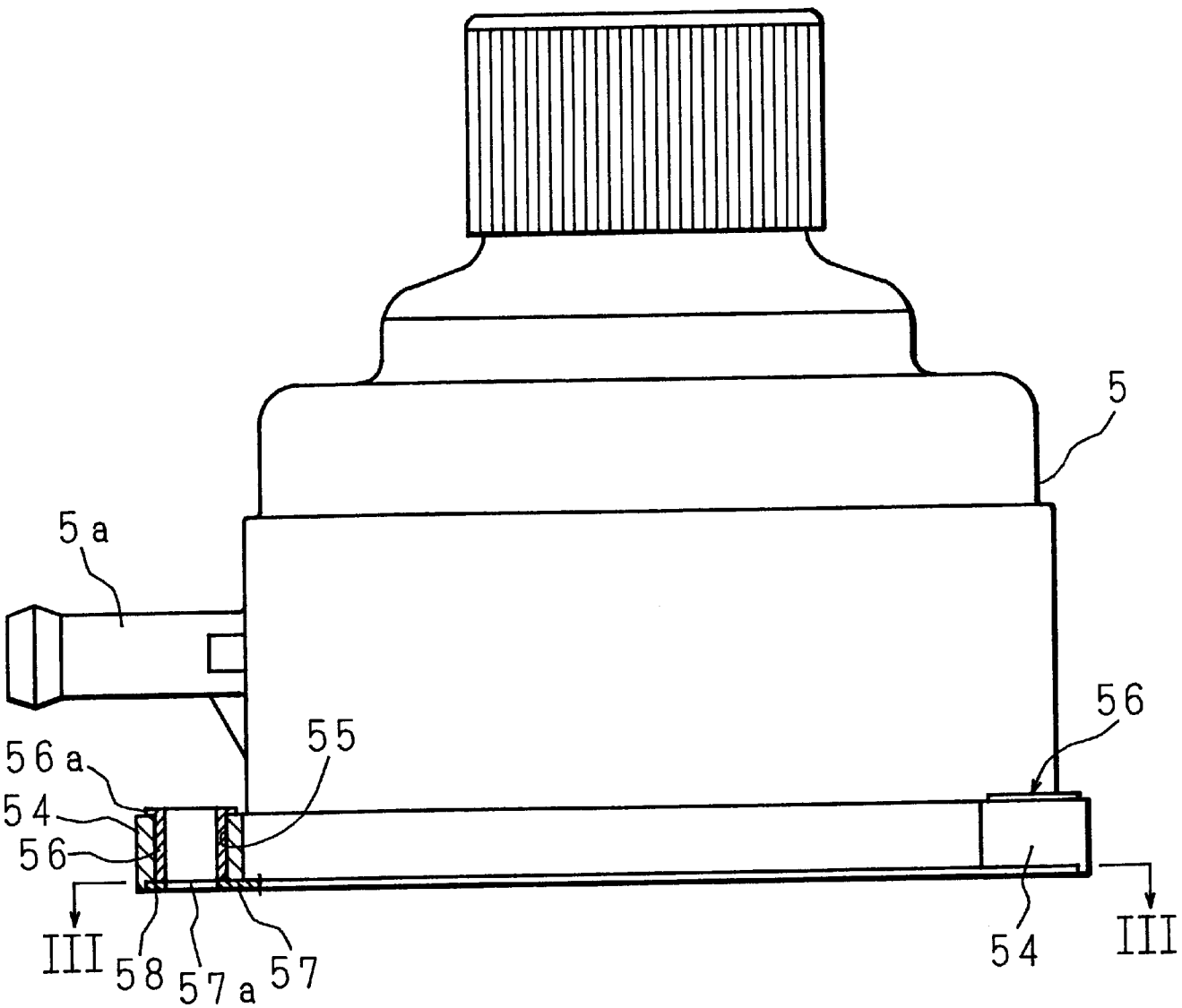
FIG. 16 is a side view showing the tank cylinder shown in FIG. 15.
Figure 17:
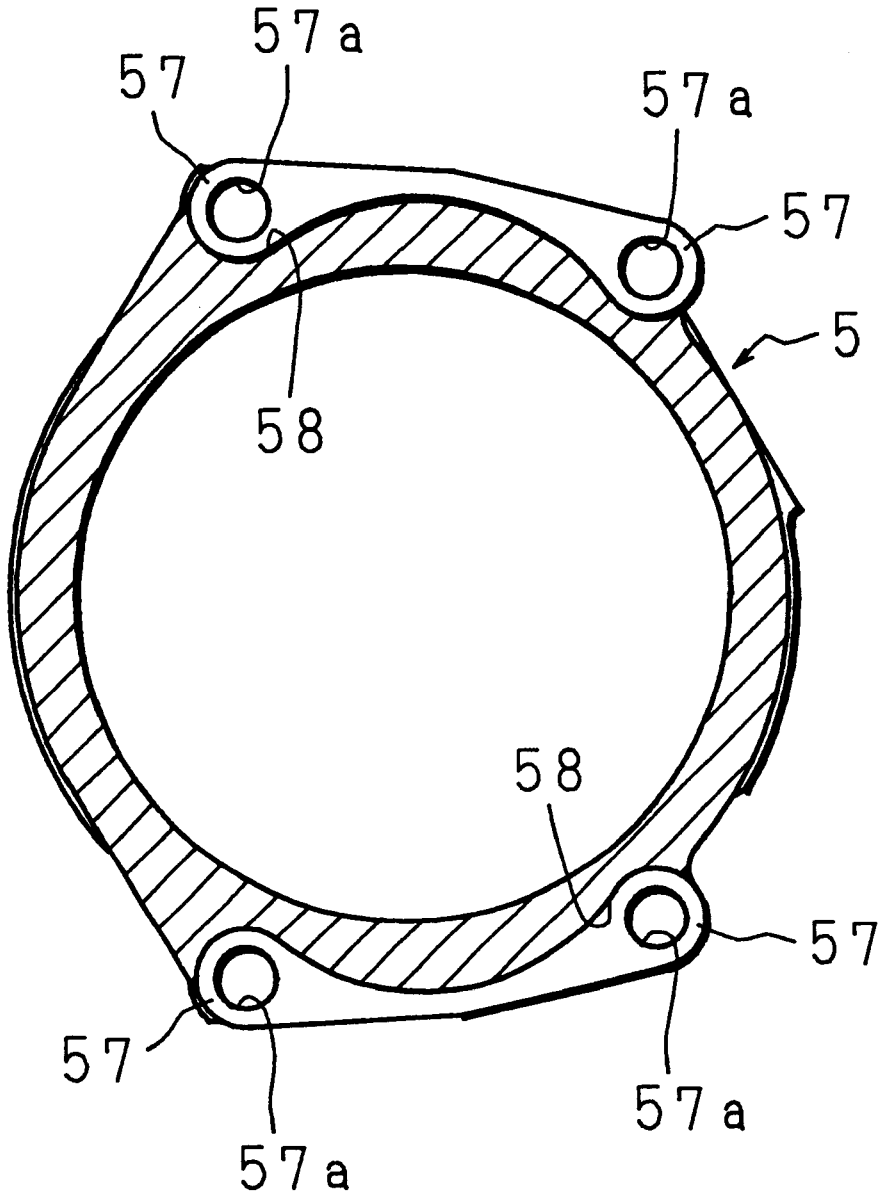
FIG. 17 is a lateral cross-sectional view taken along line III—III of FIG. 16.
Figure 18:
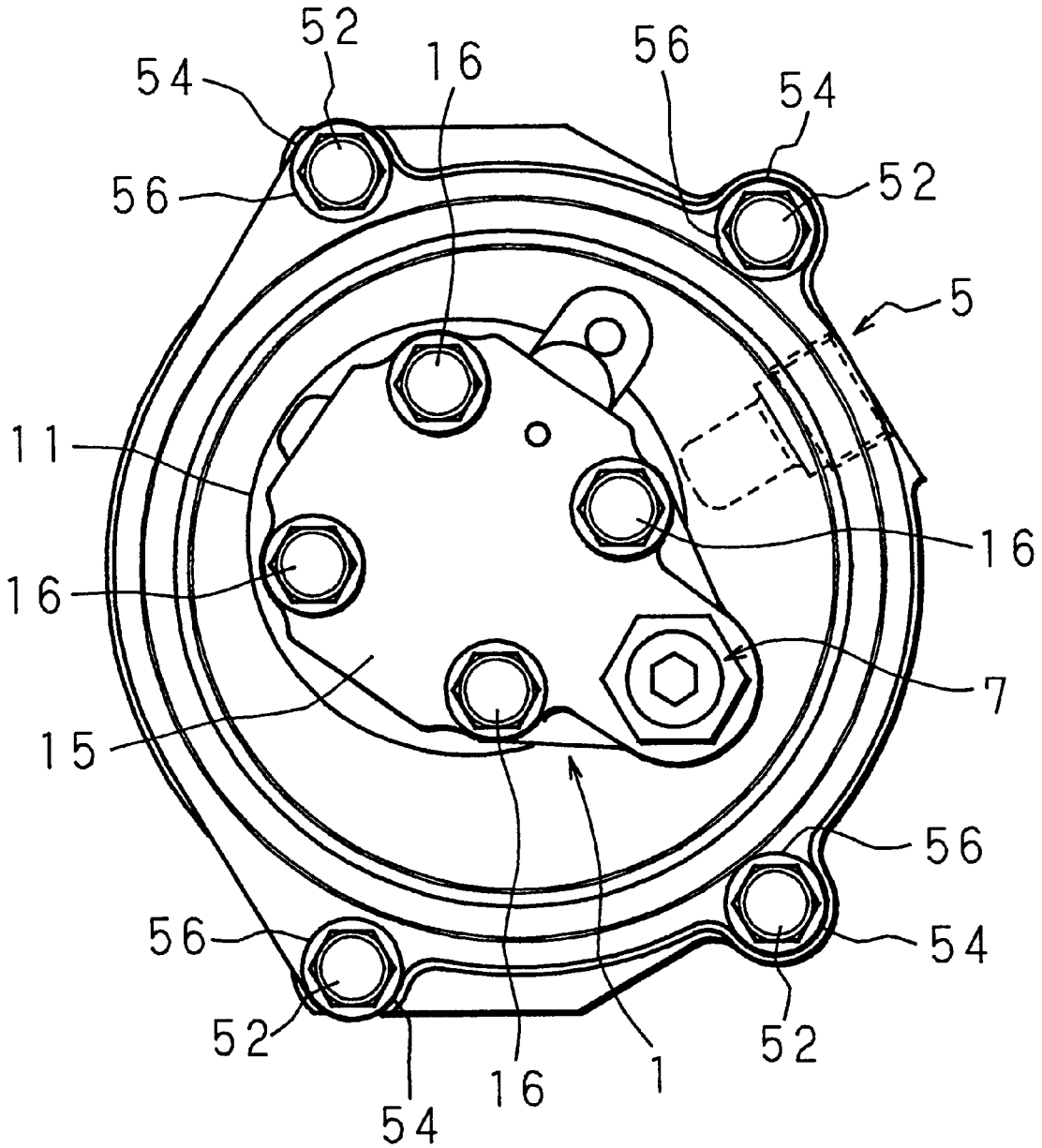
FIG. 18 is a lateral cross-sectional view taken along line II—II of FIG. 15.

FIG. 15 is an exploded side view showing an essential part of the sixth embodiment of an electric pump apparatus according to the present invention, from which an electric motor section is omitted. FIG. 16 is a side view showing the tank cylinder shown in FIG. 15, FIG. 17 is a lateral cross-sectional view taken along line III—III of FIG. 16, and FIG. 18 is a lateral cross-sectional view taken along line II—II of FIG. 15.

The electric pump apparatus of the sixth embodiment is provided with: a synthetic-resin-made tank cylinder 5 for surrounding the pump I having a plurality of flanges 54 which are secured onto the intermediate plate 17 or 17A by the securing bolts 52; metal-made collars 56 which are inserted through the perforations 55 formed in the flanges 54; and a plurality of (four in this case) of metal-made washer plates 57 which are intervened between the collars 56 and intermediate plate 17 or 17A. Here, a plurality of the washer plates 57 (two in this case) are integrally formed. Except this arrangement, the electric pump apparatus of the sixth embodiment is similar to the electric pump apparatus of the third or fourth embodiment; therefore, the same reference numerals are used for similar members and the detailed description of the other arrangements and functions is omitted.

Figure 19:
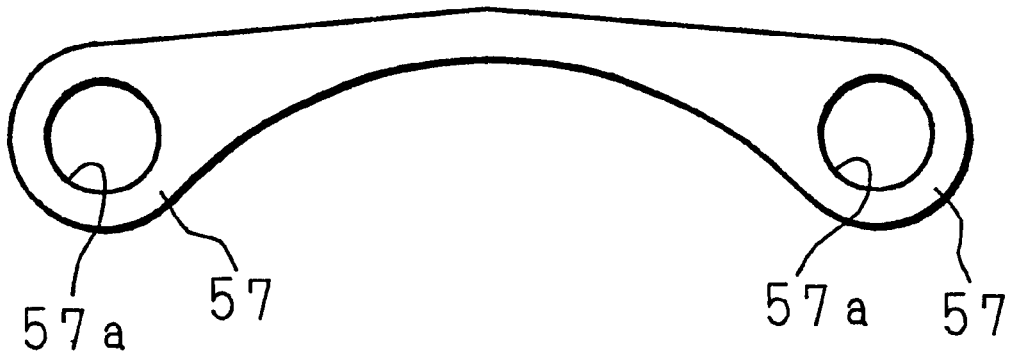
FIG. 19 is a plan view showing the washer plate shown in FIG. 15.

FIG. 19 is a plan view showing the washer plates. The washer plates 57 is formed into a approximately arc shape, and one end portion and the other end portion in its lengthwise direction are made to be gradually wider than intermediate portion, and perforations 57*a* for securing the bolts 52 are provided in these one and other end portions.

The collar 56 has a cylindrical shape in which one end portion has a tapered surface on its outer circumference and the other end portion has flange 56*a*. The collar 56 is inserted through a perforation 55 of the flange 54 from the cylindrical portion side of the tank cylinder 5 so as to allow the flange 56*a* to come in contact with mounting surface of the flange 54.

Moreover, a pair of recessed portions 58, each having a depth corresponding to thickness of the washer plate 57, are provided in the end surface on the flange 54 side of the tank cylinder 5 so that the recessed portions 58 are allowed to receive the washer plate 57.

In the sixth embodiment, for example, the washer plates 57 are placed into the respective paired recessed portions 58 of the tank cylinder 5, as well as inserting the collars 56 into the perforations 55 of the flanges 54. The tank cylinder 5 is directed to be contact with surface of the intermediate plate 17 or 17A on the pump 1 side, and the securing bolts 52 are inserted through the holes of the collars 56 and the perforations 171*h* of the intermediate plate 17 or 17A and bracket 2. Then, the securing bolts 52 are screwed into the threaded holes of the electric motor 3 side member so as to be clumped thus the tank cylinder 5 is secured to the intermediate plate 17 or 17A, and the intermediate plate 17 or 17A and bracket 2 are secured to the electric motor 3 side member. In this case, since the fastening forces of the securing bolts 52 can be applied to the metal-made intermediate plate 17 or 17A through the collars 56 and washer plates 57, buckling of the flanges 54 of the synthetic-resin-made tank cylinder 5 can be prevented by the collars 56, and buckling of the mounting surface of the intermediate plate 17 or 17A can be preferably prevented by the washer plates 57; thus, it is possible to ensure a predetermined fastening force.

Moreover, since the adjacent two washer plates 57 are integrally formed, probable dimensional errors of the washer plates 57 can be tremendously reduced as compared with having all washer plates formed as individual parts; thus, it is possible to easily manage the dimension of the washer plates 57. Moreover, since the number of the washer plates 57 can be reduced without decreasing the number of securing places, it is possible to improve operability for securing the of the tank cylinder and also to prevent the washer plates 57 from being erroneously left unsecured during the securing process.

Here, in the sixth embodiment, the securing bolts 52 for securing the tank cylinder 5 may be arranged to be fastened to the threaded holes formed in the bracket 2 or intermediate plate 17 or 17A, instead of being fastened to the member on the electric motor 3 side.

Embodiment 7

Figure 20:
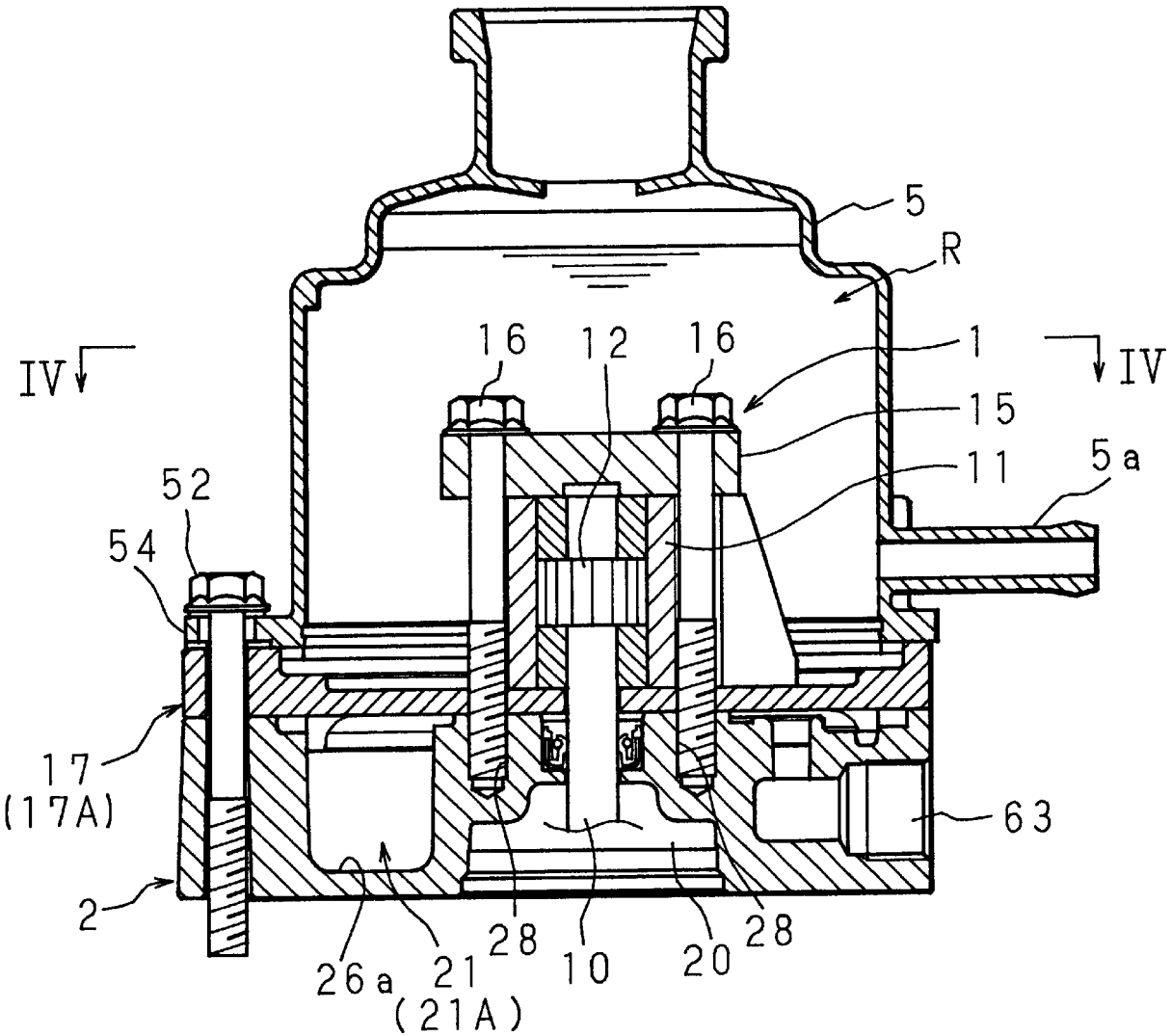
FIG. 20 is an exploded side view showing an essential part of the seventh embodiment of an electric pump apparatus from which an electric-motor section is omitted, according to the present invention.
Figure 21:
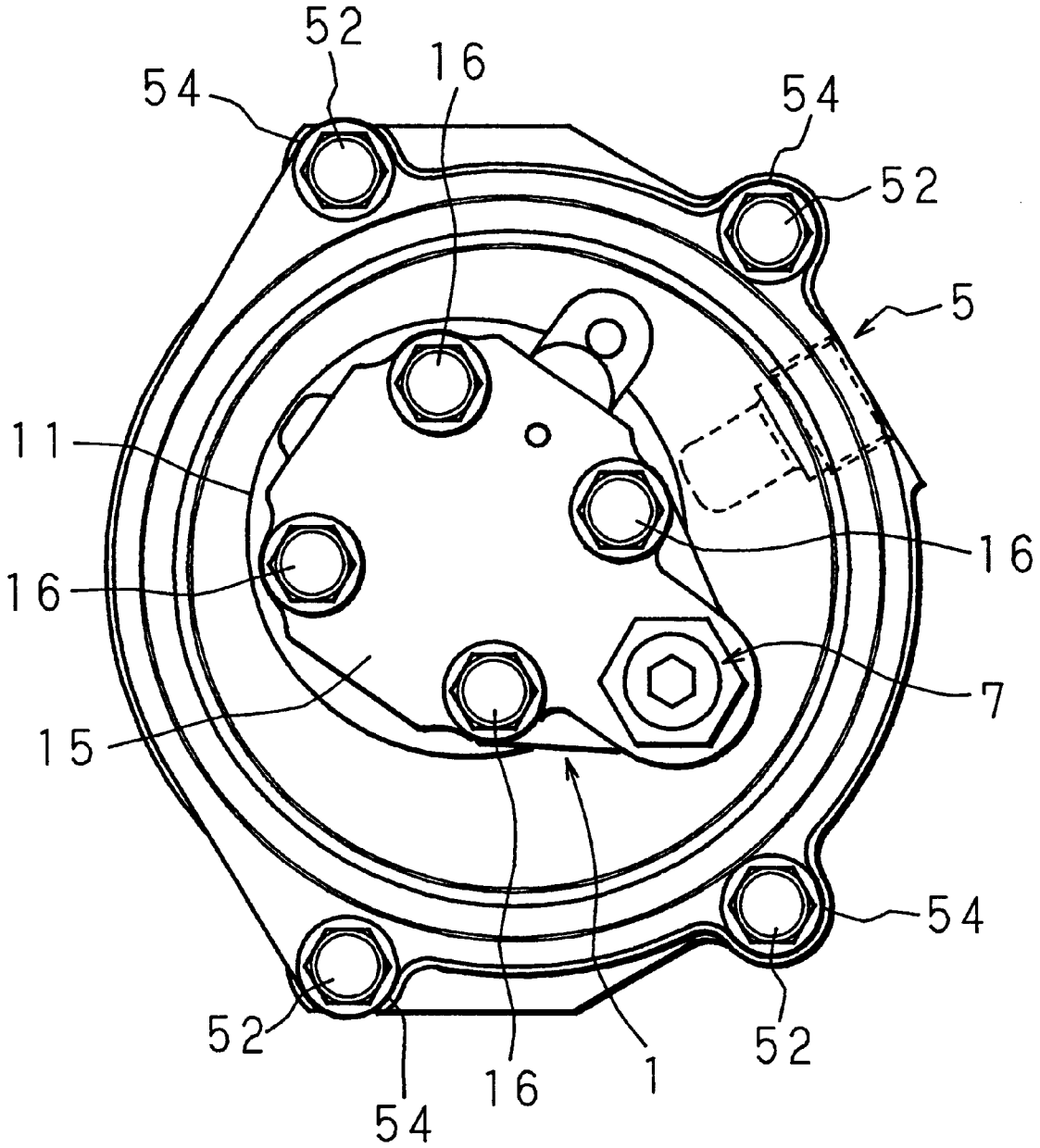
FIG. 21 is a lateral cross-sectional view taken along line IV—IV of FIG. 20.

FIG, 20 is an exploded side view showing an essential part of the seventh embodiment of an electric pump apparatus according to the present invention, from which an electric motor section is omitted, and FIG. 21 is a lateral cross-sectional view taken along line IV—IV of FIG. 20.

In the electric pump apparatus of the seventh embodiment, the pump 1 is secured to the bracket 2 by a plurality of the securing bolts 16, and the tank cylinder 5 is secured to the electric motor 3 side member by a plurality of the securing bolts 5. Except this arrangement, the electric pump apparatus of the seventh embodiment is similar to the electric pump apparatus of the third, fourth, or sixth embodiment; therefore, the same reference numerals are used for similar members and the detailed description of the other arrangements and functions is omitted.

The bracket 2 is provided with four threaded holes 28 around the shaft holes with predetermined intervals with each other, and the intermediate plate 17 or 17A is provided with perforations corresponding to those threaded holes 28. Four securing bolts 16 for securing the pump 1 having the end plate 15 and housing 11 are inserted through the perforations, and the pump 1 is secured to the bracket 2 by fastening to the threaded holes 28. Moreover, the tank cylinder 5 is provided with a plurality of flanges 54 having perforations 55 with a predetermined interval, as well as providing perforations corresponding to the perforations 55 to the intermediate plate 17 or 17A and bracket 2. Thereby, the tank cylinder 5 is secured to the intermediate plate 17 or 17A by inserting the four securing bolts 52 into these perforations and fastening to the electric motor 3 side member.

The seventh embodiment is a constitution in which the most portion of the groove 26*a* formed on the pump 1 side surface of the bracket 2 is released so as to increase volume of the suppression chamber 21 or 21A; furthermore the securing bolts 16 for securing the pump 1 and the securing bolts 52 for securing the tank cylinder 5 are utilized so as to constitute the suppression chamber 21 or 21A together with the groove 26*a*. Therefore, in order to secure the intermediate plate 17 or 17A that has a greater operable area subjected to fluid pressure reaction force applied by the suppression chamber 21 or 21A, bolts with a comparatively small diameters can be used as the securing bolts 16 and 52. Moreover, weight of the securing bolts for securing the intermediate plate 17 or 17A can be reduced with the result that weight of the entire electric pump apparatus can also be reduced. Furthermore, even when optimizing the maximum outlet pressure of the pump 1, the intermediate plate 17 or 17A can be firmly secured without the need for increasing the number of the securing bolts 16 and 52 by using high-tensile-strength bolts.

Embodiment 8

Figure 22:
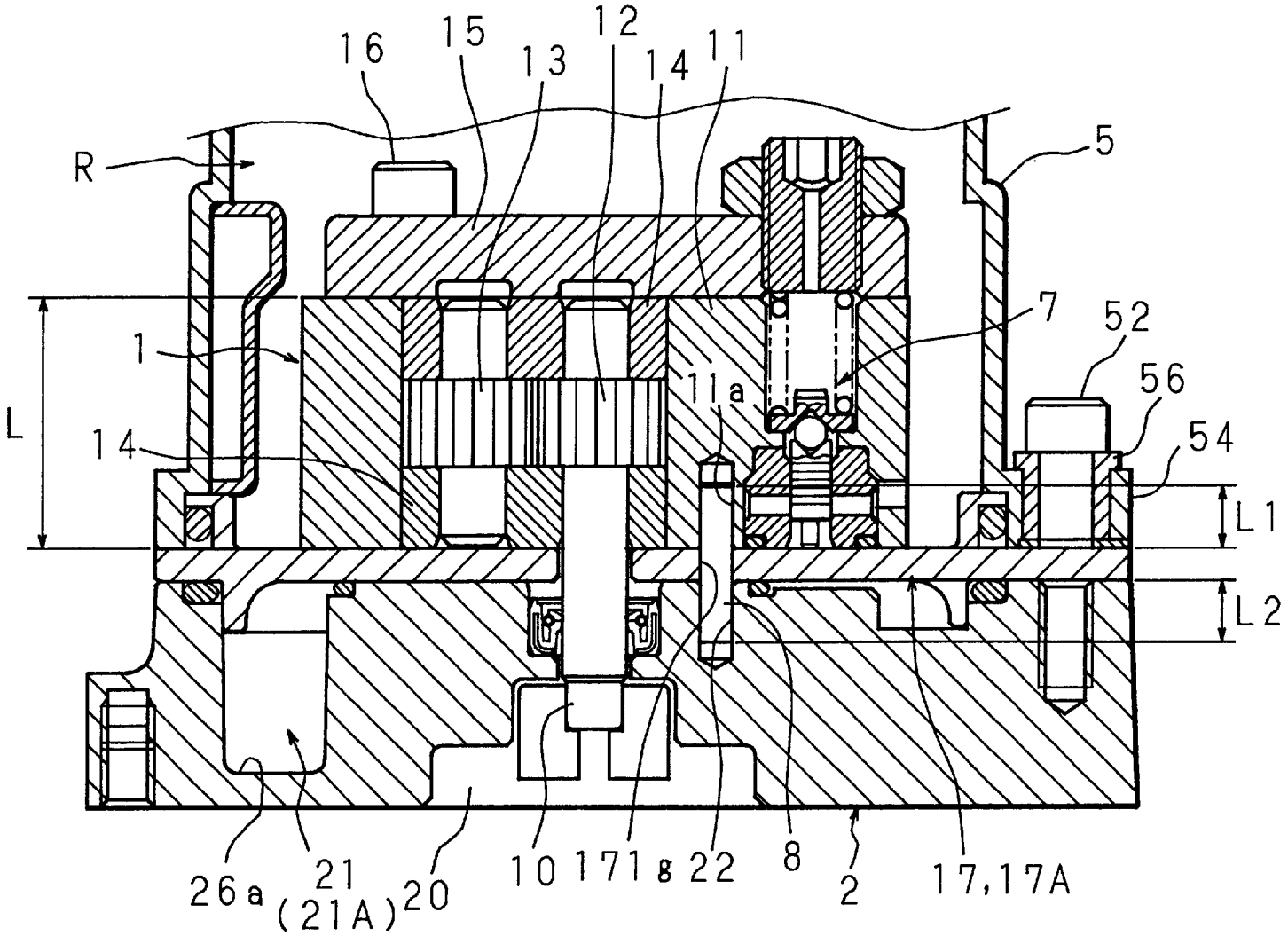
FIG. 22 is an enlarged cross-sectional view showing a securing section for securing a pump to a bracket in the eighth embodiment of an electric pump apparatus according to the present invention.

FIG. 22 is an enlarged cross-sectional view showing a securing section for securing a pump to a bracket in the eighth embodiment of an electric pump apparatus according to the present invention. In the electric pump apparatus of the eighth (embodiment, a pair of first positioning holes 11*a* are provided to the housing 11, a pair of second positioning holes 171*g* corresponding to the positioning holes 11*a* are provided to the intermediate plate 17 or 17A, and a pair of third positioning holes 22 are formed to the bracket 2. By fitting positioning pins 8 into the first through third positioning holes 11*a*, 171*g*, and 22, positioning of the intermediate plate 17 or 17A and bracket 2 with respect to the housing 11 can be appropriately made. And here, fitting depths L1 and L2 of the positioning pins 8 to the first and third positioning holes 11*a* and 22 are set within a range of 22% to 35% with respect to length L in the shaft direction of the housing 11. Except this arrangement, the electric pump apparatus of the eighth embodiment is similar to the electric pump apparatus of the third, fourth, sixth, or seventh embodiment shown in FIG. 7; therefore, the same reference numerals are used for similar members and the detailed description of the other arrangements and functions is omitted.

In the electric pump apparatus disclosed in the above-mentioned Japanese Laid-Open Patent Application No. 10-82377 (1998), the fitting depths L1 and L2 of the positioning pins 8 into the first and third positioning holes 11*a* and 22 are set within a range of 7% to 11% with respect to the length L in the shaft direction of the housing 11; therefore, the housing 11 having the driving gear 12 and driven gear 13 inside becomes a vibration source, with its resonance point within a practical frequency band, thereby it tends to be causing noises. However, the fitting dimensions L1 and L2 of the positioning pins 8 of the eighth embodiment is set to be within the range of 22% to 35% as described above.

Moreover, in the electric pump apparatus disclosed in the above-mentioned Japanese Laid-Open Patent Application No. 10-82377 (1998), the positioning pins 8 are fitted into the first through third positioning holes 11*a*, 171*g*, and 22 so as to be lose-fitted. However, the positioning pins 8 of the eighth embodiment are fitted into the first through third positioning holes 11*a*, 171*g*, and 22 so as to be tight-fitted, thereby clamping mutual movements of the positioning pins 8, housing 11, intermediate plate 17 or 17A, and bracket 2.

In the eighth embodiment, the positioning pins 8, which are placed in the vicinity of the vibration source, are utilized, and the fitting depths L1 and L2 of the positioning pins 8 to the first and third positioning holes 11*a* and 22 are set approximately three times longer, as compared with the conventional configuration. Therefore, it can shift the resonance point out of the practical frequency band, and consequently it can eliminate generation of noises due to the housing 11 by being a vibration source, without need for adding a particular arrangement. Moreover, since the positioning pins 8 are fitted into the first through third positioning holes 11*a*, 171*g*, and 22 so as to be fastened therein; therefore it can further reduce generation of noises caused by the housing 11 being a vibration source.

Embodiment 9

Figure 23:
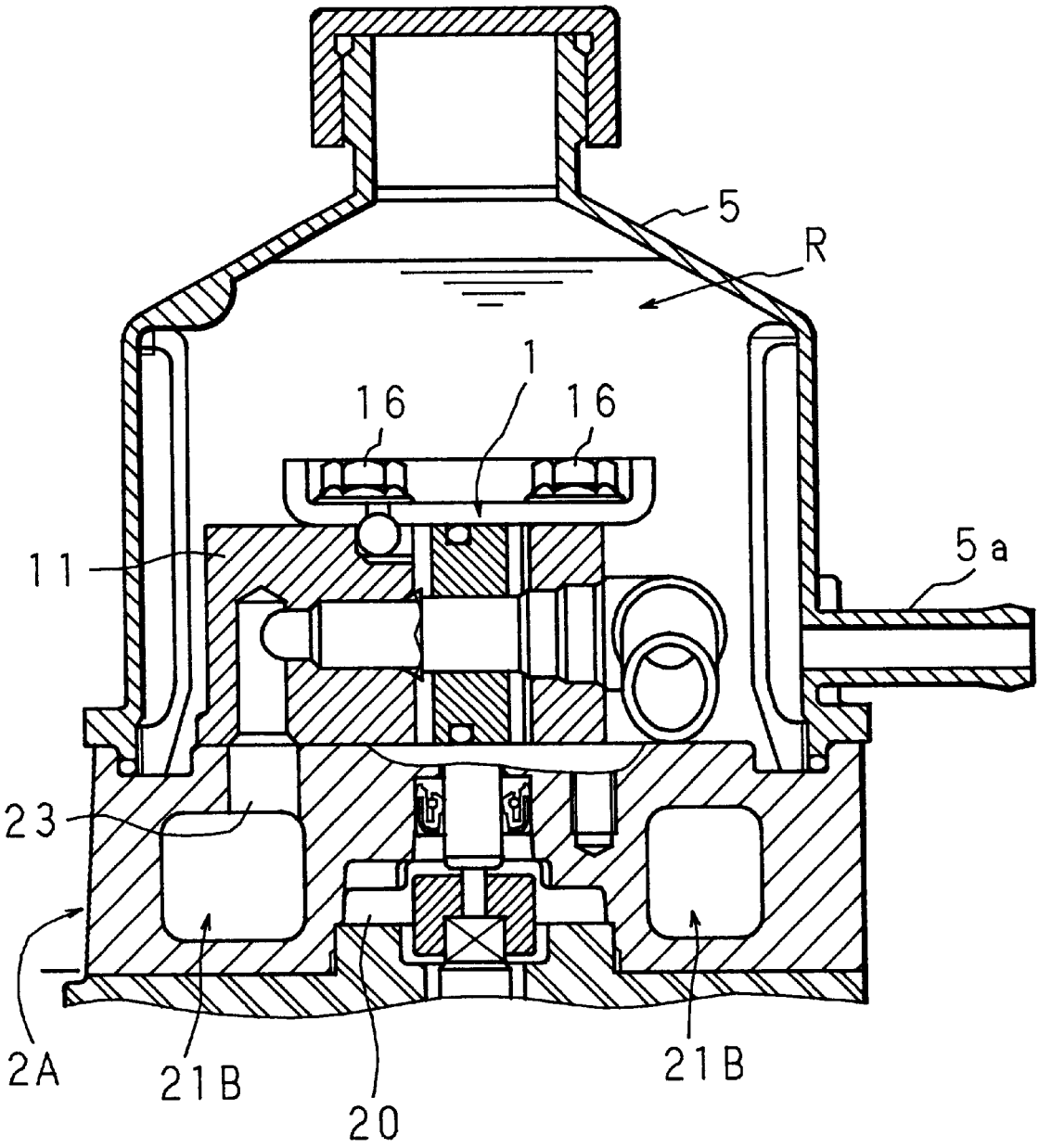
FIG. 23 is an exploded side view showing an essential part of the ninth embodiment of an electric pump apparatus from which an electric-motor section is omitted, according to the present invention.

FIG. 23 is an exploded side view showing an essential part of the ninth embodiment of an electric pump apparatus according to the present invention, from which an electric motor section is omitted. In the electric pump apparatus of the ninth embodiment, instead of forming the suppression chamber 21 or 21A by the groove 26*a* and intermediate plate 17 or 17A, a built-in suppression chamber 21B having a approximately C-shape inside tire bracket 2A is provided. Except this arrangement, the electric pump apparatus of the ninth embodiment is similar to the electric pump apparatus of the third embodiment shown in FIG. 7; therefore, the same reference numerals are used for similar members and the detailed description of the other arrangements and functions is omitted.

Figure 24:
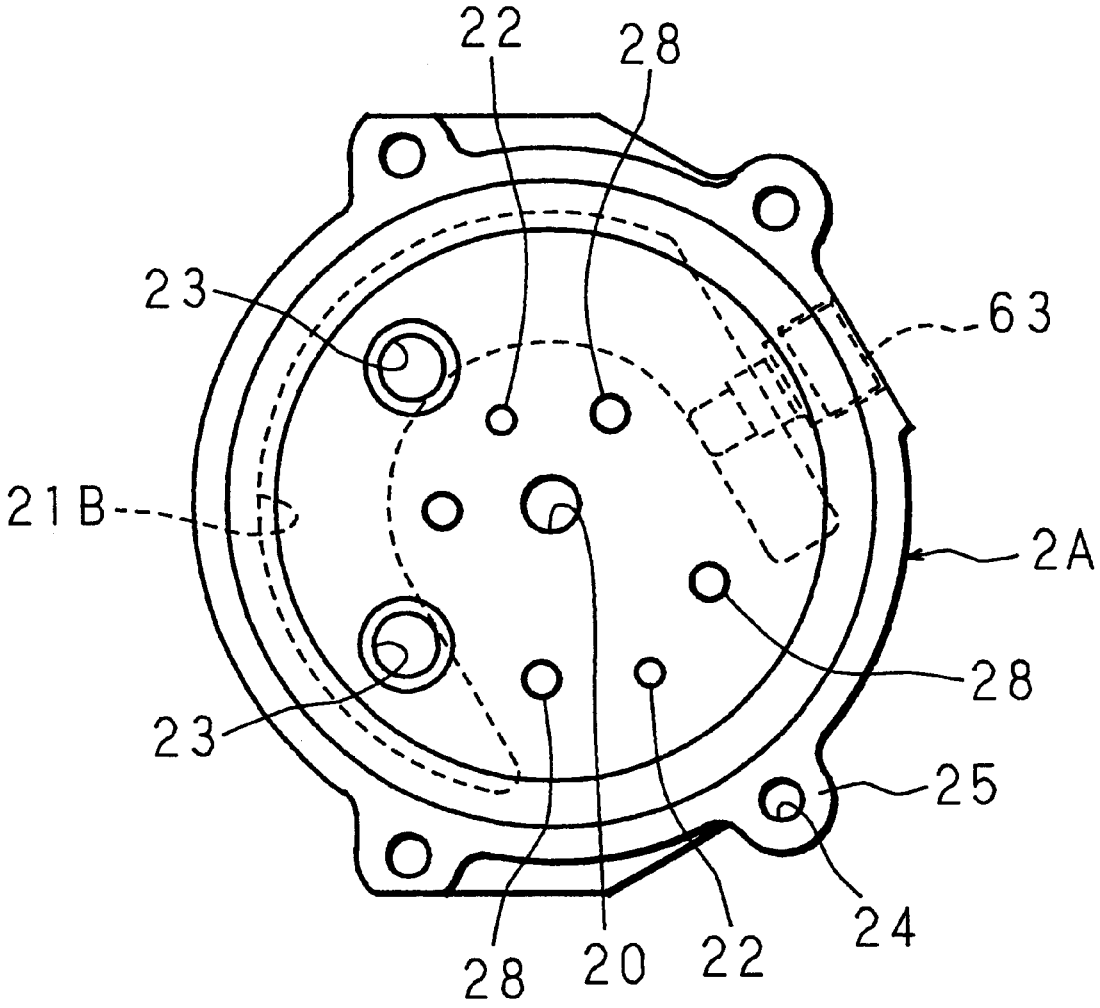
FIG. 24 is a plan view showing the bracket of FIG. 23.
Figure 25:
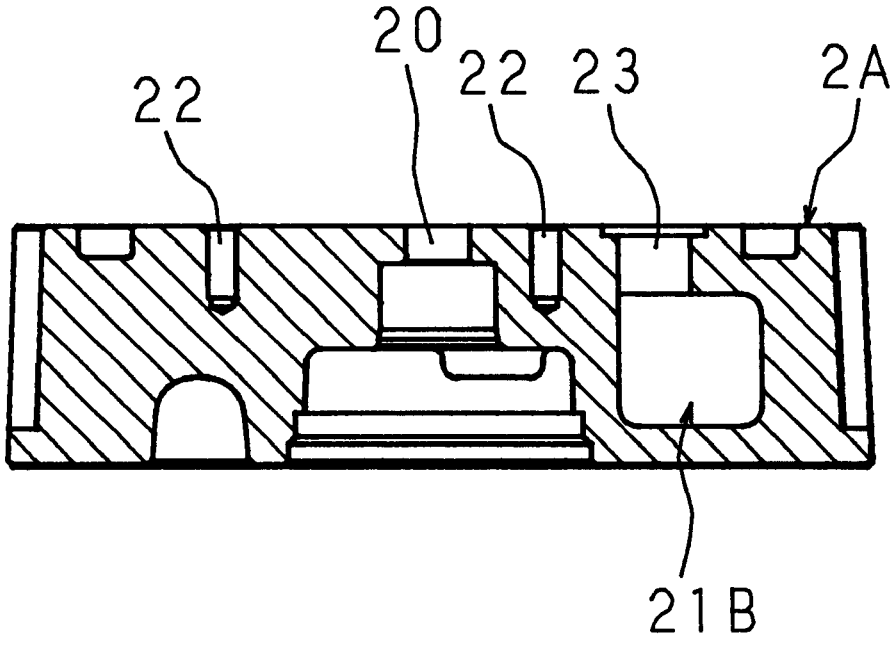
FIG. 25 is a cross-sectional view showing the bracket of FIG. 23.
Figure 26:
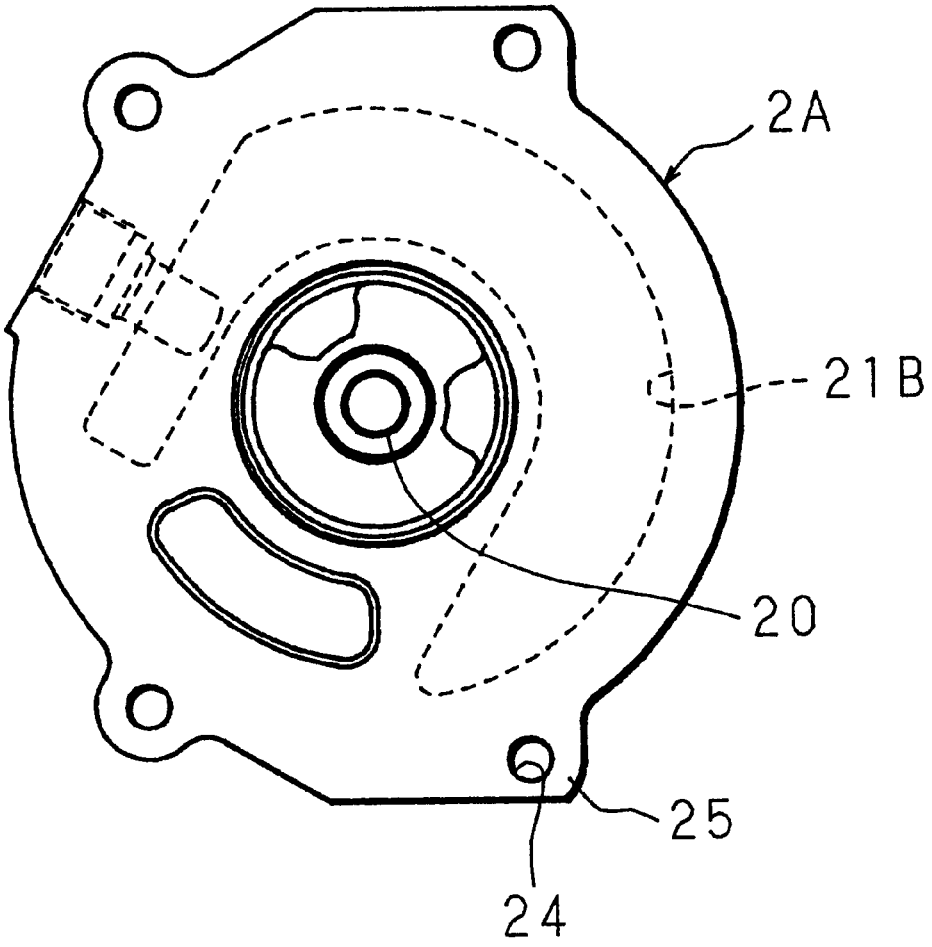
FIG. 26 is a bottom view of the bracket of FIG. 23.
Figure 27B:
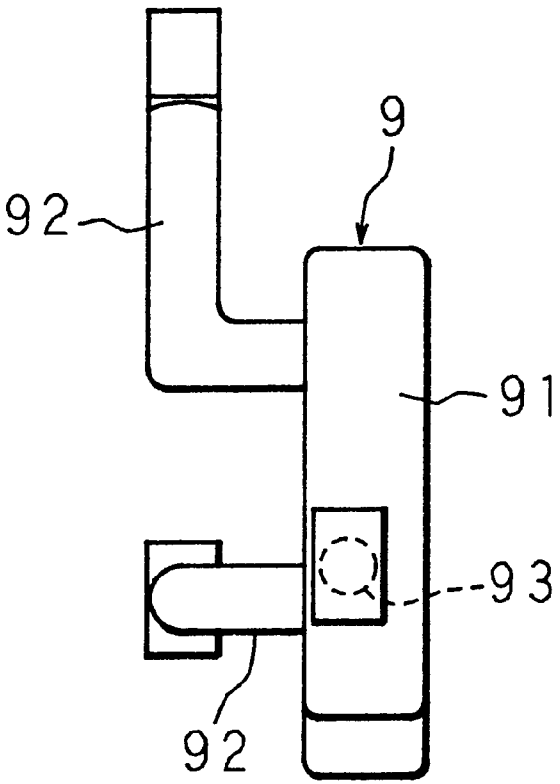
FIG. 27B is a side view showing the shell core for forming the suppression chamber shown in FIG. 23.
Figure 27A:
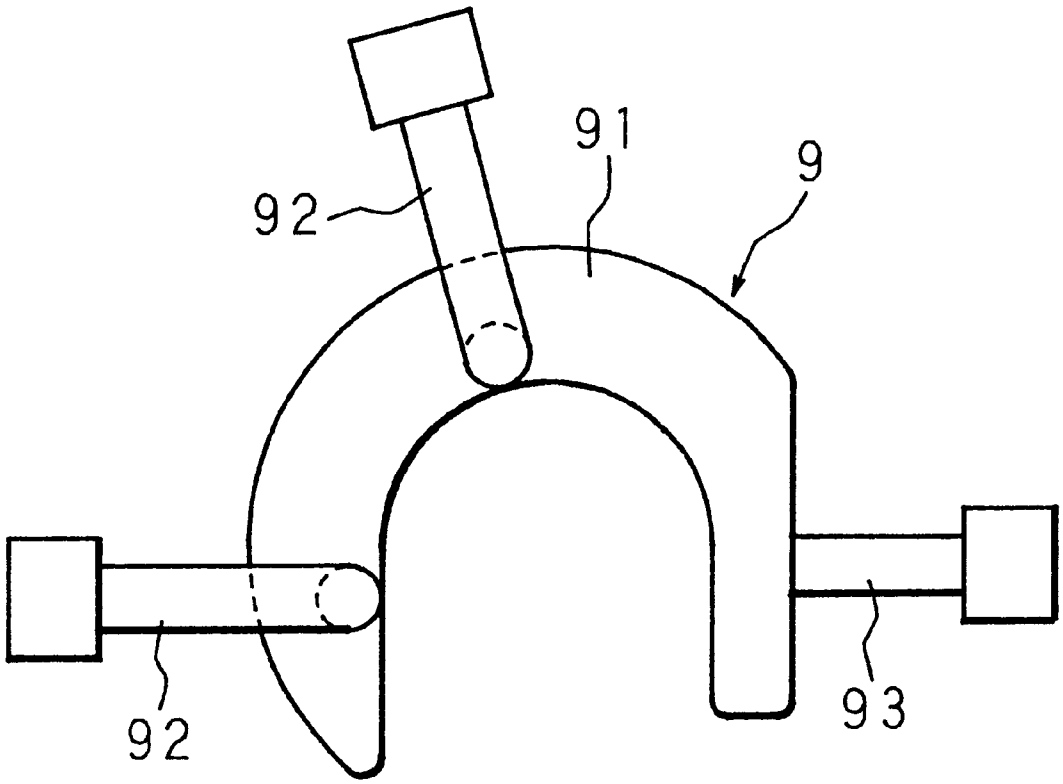
FIG. 27A is a plan view showing a shell core for forming the suppression chamber shown in FIG. 23.

FIGS. 24 through 26 are plan, cross-sectional, and bottom views of the bracket shown in FIG. 23, respectively; and FIGS. 27A and 27B are plan and side views showing a shell core for forming the suppression chamber shown in FIG. 23, respectively.

The suppression chamber 21B is molded by using, for example, a gravity method by utilizing a shell core 9. This gravity method uses a pair of split dies (not shown) for molding the bracket 2A, and the shell core 9 corresponding to the suppression chamber 21B. This shell core 9 is made of sand and solidified by a synthetic-resin bonding agent, and it is provided with a core main body 91 having a approximately C-shape corresponding to the suppression chamber 21B, a pair of first arm portions 92 for molding two inlet holes 23, and a second arm portion 93 for molding the connecting port 63.

This shell core 9 is placed inside the pair of split dies, and then a molten aluminum alloy material or molten high-tensile-strength aluminum material is poured into the split dies to mold the bracket 2A. Next, after the bracket 2A has been cooled off, the lump of sand is made to collapse, and the sand inside the bracket 2A is discharged outside through the inlet holes 23 and connecting port 63, the inside of the bracket 2A is shot-blasted, and then the bracket 2A itself is allowed to have a built-in suppression chamber 21B.

Here, the bracket 2A is provided with a pair of positioning holes 22 corresponding to the positioning holes 171*g* of the intermediate plate 17 or 17A, and a flange 25 having perforations 24 corresponding to the perforations 55 of the flange 54.

In the ninth embodiment, since the suppression chamber 21B can be constituted only with the bracket 2A without using the intermediate plate 17 or 17A as described in the third and fourth embodiments, as compared with the third and fourth embodiments in which the suppression chamber 21 or 21A is formed by the groove 26*a* and intermediate plate 17 or 17A, it becomes possible to reduce the number of parts, and consequently to greatly reduce costs.

Moreover, an inlet hole 23 for introducing pressurized fluid discharged from the pump 1 is provided on the pump 1 side surface of the bracket 2A, without allowing most of the suppression chamber 21 or 21A to be released as the third and fourth embodiments Therefore, the operable area subjected to the fluid pressure reaction force applied from the suppression chamber 21B to the pump 1 can he reduced as compared with the third and fourth embodiments, and this makes it possible to reduce the axial force required for the securing bolts to secure the pump 1 to the bracket 2A, and also to firmly secure the pump 1 with small-size securing bolts; thus it becomes possible to make the entire electric pump apparatus compact.

Additionally, in the above-mentioned electric pump apparatus according to the present invention, the suppression chamber 21, 21A, and 21B may be provided as, for example, an annular shape as the third embodiment, or may be provided as an approximately C-shape as the ninth embodiment. Moreover, two or more suppression chambers 21, 21A, and 21B may be provided around the shaft hole 20 and 171*c*, and these chambers may be connected to each other by communicating paths. Therefore, the present invention does not particularly limit constitutions of the suppression chamber.

Furthermore, although the fourth through ninth embodiments are given as examples that are constituted based upon the third embodiment, the constitutions of these third through ninth embodiments may of course be applied to the electric pump apparatus having the mounting constitution of the tank cylinder 5 shown in the first and second embodiments.

Moreover, the above-mentioned embodiments have dealt with hydraulic-type electric pump apparatuses which are to be mounted on vehicles so as obtain operating fluid for hydraulic apparatuses such as power steering apparatuses and automatic transmission apparatuses; however, the present invention may of course be applied to electric pump apparatuses other than those used for vehicle-mount pumps, and may be further applied to electric pump apparatuses using fluid other than oil. Furthermore, the pump 1 is not intended to be limited to a gear pump as explained in the above-mentioned embodiments, and may be other pumps of the rotational volume type, such as vane pumps.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An electric pump apparatus, comprising:

a pump;

an electric motor for driving the pump;

a cylindrical bracket for supporting the pump and electric motor on its respective end surfaces, with a groove being circumferentially provided to the end surface;

a bottomed-cylindrical tank cylinder for constituting a reservoir by fitting its opening-side-end portion into the groove provided on the pump side end surface of the bracket so as to surround the pump; and an anti-come-off ring for securing the tank cylinder by engaging the opening-side-end portion of the tank cylinder with a side wall of the groove so that the tank cylinder does not come off from the groove;

wherein the tank cylinder includes:

fitting portion having a predetermined length from its opening edge with a thickness approximately equal to width of the groove;

an inlet surface which is located at a position farther from the opening edge than the fitting portion and which faces the side wall of the groove with a gap which allows the anti-come-off ring to be introduced when fitting into the groove;

a guide surface, which is located between the inlet surface and fitting portion, which is outwardly inclined toward the opening edge, and which introduces the anti-come-off ring along the inlet surface to its engaging position; and an engage surface which has a curved surface continuously provided with the guide surface and which touches the anti-come-off ring being engaged at the engaging position.

2. The electronic pump apparatus according to claim 1, further comprising:

a biasing member, being intervened between the opening edge of the tank cylinder and the bottom surface of the groove, for pushing the engage surface against the anti-come-off ring by biasing the tank cylinder away from the bottom surface.

3. An electric pump apparatus comprising:

a pump;

an electric motor for driving the pump;

a cylindrical bracket for supporting the pump and electric motor on its respective end surfaces, with a groove being circumferentially provided to the end surface;

a bottomed-cylindrical tank cylinder for constituting a reservoir by fitting its opening-side-end portion into the groove provided on the pump side end surface of the bracket so as to surround the pump; and an anti-come-off ring for securing the tank cylinder by engaging the opening-side-end portion of the tank cylinder with a side wall of the groove so that the tank cylinder does not come off from the groove;

wherein the anti-come-off ring is a snap ring having a circular cross-section;

wherein the tank cylinder includes:

a fitting portion having a predetermined length from its opening edge with a thickness approximately equal to width of the groove;

an inlet surface which is located at a position farther from the opening edge than the fitting portion and which faces the side wall of the groove with a gap which allows the anti-come-off ring to be introduced when fitting into the groove;

a guide surface, which is located between the inlet surface and fitting portion, which is outwardly inclined toward the opening edge, and which introduces the anti-come-off ring along the inlet surface to its engaging position; and an engage surface which has a curved surface continuously provided with the guide surface and which touches the anti-come-off ring being engaged at the engaging position.

* * * * *